US011103920B2

(12) United States Patent
Cooper et al.

(10) Patent No.: US 11,103,920 B2
(45) **Date of Patent: *Aug. 31, 2021**

(54) TRANSFER STRUCTURE WITH MOLTEN METAL PUMP SUPPORT

(71) Applicant: Molten Metal Equipment Innovations, LLC, Middlefield, OH (US)

(72) Inventors: Paul V. Cooper, Chesterland, OH (US); Vincent D. Fontana, Chagrin Falls, OH (US)

(73) Assignee: Molten Metal Equipment Innovations, LLC, Middlefield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/728,938

(22) Filed: Dec. 27, 2019

(65) Prior Publication Data

US 2020/0130050 A1 Apr. 30, 2020

Related U.S. Application Data

(60) Continuation of application No. 15/849,479, filed on Dec. 20, 2017, now Pat. No. 10,562,097, which is a (Continued)

(51) Int. Cl.
*B22D 41/02* (2006.01)
*F27D 3/14* (2006.01)

(Continued)

(52) U.S. Cl.
CPC ..... *B22D 41/02* (2013.01); *B22D 7/00* (2013.01); *B22D 37/00* (2013.01); *B22D 39/00* (2013.01);

(Continued)

(58) Field of Classification Search
CPC ..... B22D 41/02; B22D 7/00; B22D 37/00; B22D 39/00; B22D 41/00; C22B 21/0084; C22B 21/064; F27D 3/14; F27D 27/005

See application file for complete search history.

(56) References Cited

U.S. PATENT DOCUMENTS 35,604 A 6/1862 Guild
116,797 A 7/1871 Barnhart (Continued)

FOREIGN PATENT DOCUMENTS

CA 683469 3/1964
CA 2115929 8/1992

(Continued)

OTHER PUBLICATIONS

"Response to Final Office Action and Request for Continued Examination for U.S. Appl. No. 09/275,627," Including Declarations of Haynes and Johnson, dated Apr. 16, 2001.

(Continued)

*Primary Examiner* — Scott R Kastler
(74) *Attorney, Agent, or Firm* — Snell & Wilmer L.L.P.

(57) ABSTRACT

The invention relates to systems for transferring molten metal from one structure to another. Aspects of the invention include a transfer chamber constructed inside of or next to a vessel used to retain molten metal. The transfer chamber is in fluid communication with the vessel so molten metal from the vessel can enter the transfer chamber. A powered device, which may be inside of the transfer chamber, moves molten metal upward and out of the transfer chamber and preferably into a structure outside of the vessel, such as another vessel or a launder.

32 Claims, 11 Drawing Sheets

Related U.S. Application Data continuation of application No. 14/811,655, filed on Jul. 28, 2015, now Pat. No. 9,855,600, which is a continuation of application No. 13/802,040, filed on Mar. 13, 2013, now Pat. No. 9,156,087, which is a continuation-in-part of application No. 13/725,383, filed on Dec. 21, 2012, now Pat. No. 9,383,140, which is a division of application No. 11/766,617, filed on Jun. 21, 2007, now Pat. No. 8,337,746.

(51) Int. Cl.

| | |
|---|---|
| ***B22D 37/00*** | (2006.01) |
| ***B22D 41/00*** | (2006.01) |
| ***B22D 7/00*** | (2006.01) |
| ***B22D 39/00*** | (2006.01) |
| ***C22B 21/00*** | (2006.01) |
| ***C22B 21/06*** | (2006.01) |
| ***F27D 27/00*** | (2010.01) |

(52) U.S. Cl.

CPC ..... *B22D 41/00* (2013.01); *C22B 21/0084* (2013.01); *C22B 21/064* (2013.01); *F27D 3/14* (2013.01); *F27D 27/005* (2013.01); *Y10T 29/49* (2015.01)

(56) References Cited

U.S. PATENT DOCUMENTS 209,219 A 10/1878 Bookwalter
251,104 A 12/1881 Finch
307,845 A 11/1884 Curtis
364,804 A 6/1887 Cole
390,319 A 10/1888 Thomson
495,760 A 4/1893 Seitz
506,572 A 10/1893 Wagener
585,188 A 6/1897 Davis
757,932 A 4/1904 Jones
882,477 A 3/1908 Neumann
882,478 A 3/1908 Neumann
890,319 A 6/1908 Wells
898,499 A 9/1908 O'donnell
909,774 A 1/1909 Flora
919,194 A 4/1909 Livingston
1,037,659 A 9/1912 Rembert
1,100,475 A 6/1914 Frankaerts
1,170,512 A 2/1916 Chapman
1,196,758 A 9/1916 Blair
1,304,068 A 5/1919 Krogh
1,331,997 A 2/1920 Neal
1,185,314 A 3/1920 London
1,377,101 A 5/1921 Sparling
1,380,798 A 6/1921 Hansen et al.
1,439,365 A 12/1922 Hazell
1,454,967 A 5/1923 Gill
1,470,607 A 10/1923 Hazell
1,513,875 A 11/1924 Wilke
1,518,501 A 12/1924 Gill
1,522,765 A 1/1925 Wilke
1,526,851 A 2/1925 Hall
1,669,668 A 5/1928 Marshall
1,673,594 A 6/1928 Schmidt
1,697,202 A 1/1929 Nagle
1,717,969 A 6/1929 Goodner
1,718,396 A 6/1929 Wheeler
1,896,201 A 2/1933 Sterner-Rainer
1,988,875 A 1/1935 Saborio
2,013,455 A 9/1935 Baxter
2,038,221 A 4/1936 Kagi
2,075,633 A 3/1937 Anderegg
2,090,162 A 8/1937 Tighe
2,091,677 A 8/1937 Fredericks
2,138,814 A 12/1938 Bressler
2,173,377 A 9/1939 Schultz, Jr. et al.
2,264,740 A 12/1941 Brown
2,280,979 A 4/1942 Rocke
2,290,961 A 7/1942 Hueuer
2,300,688 A 11/1942 Nagle
2,304,849 A 12/1942 Ruthman
2,368,962 A 2/1945 Blom
2,382,424 A 8/1945 Stepanoff
2,423,655 A 7/1947 Mars et al.
2,488,447 A 11/1949 Tangen et al.
2,493,467 A 1/1950 Sunnen
2,515,097 A 7/1950 Schryber
2,515,478 A 7/1950 Tooley et al.
2,528,208 A 10/1950 Bonsack et al.
2,528,210 A 10/1950 Stewart
2,543,633 A 2/1951 Lamphere
2,566,892 A 4/1951 Jacobs
2,625,720 A 1/1953 Ross
2,626,086 A 1/1953 Forrest
2,676,279 A 4/1954 Wilson
2,677,609 A 4/1954 Moore et al.
2,698,583 A 1/1955 House et al.
2,714,354 A 8/1955 Farrand
2,762,095 A 9/1956 Pemetzrieder
2,768,587 A 10/1956 Corneil
2,775,348 A 12/1956 Williams
2,779,574 A 1/1957 Schneider
2,787,873 A 4/1957 Hadley
2,808,782 A 10/1957 Thompson et al.
2,809,107 A 10/1957 Russell
2,821,472 A 1/1958 Peterson et al.
2,824,520 A 2/1958 Bartels
2,832,292 A 4/1958 Edwards
2,839,006 A 6/1958 Mayo
2,853,019 A 9/1958 Thorton
2,865,295 A 12/1958 Nikolaus
2,865,618 A 12/1958 Abell
2,868,132 A 1/1959 Rittershofer
2,901,006 A 8/1959 Andrews
2,901,677 A 8/1959 Chessman et al.
2,906,632 A 9/1959 Nickerson
2,918,876 A 12/1959 Howe
2,948,524 A 8/1960 Sweeney et al.
2,958,293 A 11/1960 Pray, Jr.
2,966,345 A 12/1960 Ciabattari
2,966,381 A 12/1960 Menzel
2,978,885 A 4/1961 Davison
2,984,524 A 5/1961 Franzen
2,987,885 A 6/1961 Hodge
3,010,402 A 11/1961 King
3,015,190 A 1/1962 Arbeit
3,039,864 A 6/1962 Hess
3,044,408 A 7/1962 Mellott
3,048,384 A * 8/1962 Sweeney ..... F04D 7/065 415/88
3,070,393 A 12/1962 Silverberg et al.
3,092,030 A 6/1963 Wunder
3,099,870 A 8/1963 Seeler
3,128,327 A 4/1964 Upton
3,130,678 A 4/1964 Chenault
3,130,679 A 4/1964 Sence
3,171,357 A 3/1965 Egger
3,172,850 A 3/1965 Englesberg et al.
3,203,182 A 8/1965 Pohl
3,227,547 A 1/1966 Szekely
3,244,109 A 4/1966 Barske
3,251,676 A 5/1966 Johnson
3,255,702 A 6/1966 Gehrm
3,258,283 A 6/1966 Winberg et al.
3,272,619 A 9/1966 Sweeney et al.
3,289,473 A 12/1966 Louda
3,291,473 A 12/1966 Sweeney et al.
3,368,805 A 2/1968 Davey et al.
3,374,943 A 3/1968 Cervenka
3,400,923 A 9/1968 Howie et al.
3,417,929 A 12/1968 Secrest et al.
3,432,336 A 3/1969 Langrod
3,459,133 A 8/1969 Scheffler
3,459,346 A 8/1969 Tinnes
3,477,383 A 11/1969 Rawson et al.

(56) References Cited

U.S. PATENT DOCUMENTS 3,487,805 A 1/1970 Satterthwaite
3,512,762 A 5/1970 Umbricht
3,512,788 A 5/1970 Kilbane
3,532,445 A 10/1970 Scheffler et al.
3,561,885 A 2/1971 Lake
3,575,525 A * 4/1971 Fox ..... F04D 1/14 415/200
3,581,767 A 6/1971 Jackson
3,612,715 A 10/1971 Yedidiah
3,618,917 A 11/1971 Fredrikson
3,620,716 A 11/1971 Hess
3,650,730 A 3/1972 Derham et al.
3,689,048 A 9/1972 Foulard et al.
3,715,112 A 2/1973 Carbonnel
3,732,032 A 5/1973 Daneel
3,737,304 A 6/1973 Blayden
3,737,305 A 6/1973 Blayden et al.
3,743,263 A 7/1973 Szekely
3,743,500 A 7/1973 Foulard et al.
3,753,690 A 8/1973 Emley et al.
3,759,628 A 9/1973 Kempf
3,759,635 A 9/1973 Carter et al.
3,767,382 A 10/1973 Bruno et al.
3,776,660 A 12/1973 Anderson et al.
3,785,632 A 1/1974 Kraemer et al.
3,787,143 A 1/1974 Carbonnel et al.
3,799,522 A 3/1974 Brant et al.
3,799,523 A 3/1974 Seki
3,807,708 A 4/1974 Jones
3,814,400 A 6/1974 Seki
3,824,028 A 7/1974 Zenkner et al.
3,824,042 A 7/1974 Barnes et al.
3,836,280 A 9/1974 Koch
3,839,019 A 10/1974 Bruno et al.
3,844,972 A 10/1974 Tully, Jr. et al.
3,871,872 A 3/1975 Downing et al.
3,873,073 A 3/1975 Baum et al.
3,873,305 A 3/1975 Claxton et al.
3,881,039 A 4/1975 Baldieri et al.
3,886,992 A 6/1975 Maas et al.
3,915,594 A 10/1975 Nesseth
3,915,694 A 10/1975 Ando
3,935,003 A 1/1976 Steinke et al.
3,941,588 A 3/1976 Dremann
3,941,589 A 3/1976 Norman et al.
3,942,473 A 3/1976 Chodash
3,954,134 A 5/1976 Maas et al.
3,958,979 A 5/1976 Valdo
3,958,981 A 5/1976 Forberg et al.
3,961,778 A 6/1976 Carbonnel et al.
3,966,456 A 6/1976 Ellenbaum et al.
3,967,286 A 6/1976 Andersson et al.
3,972,709 A 8/1976 Chin et al.
3,973,871 A 8/1976 Hance
3,984,234 A 10/1976 Claxton et al.
3,985,000 A 10/1976 Hartz
3,997,336 A 12/1976 Van Linden et al.
4,003,560 A 1/1977 Carbonnel
4,008,884 A 2/1977 Fitzpatrick et al.
4,018,598 A 4/1977 Markus
4,043,146 A 8/1977 Stegherr
4,052,199 A 10/1977 Mangalick
4,055,390 A 10/1977 Young
4,063,849 A 12/1977 Modianos
4,068,965 A 1/1978 Lichti
4,073,606 A 2/1978 Eller
4,091,970 A 5/1978 Kimiyama et al.
4,119,141 A 10/1978 Thut et al.
4,125,146 A 11/1978 Muller
4,126,360 A 11/1978 Miller et al.
4,128,415 A 12/1978 Van Linden et al.
4,144,562 A 3/1979 Cooper
4,147,474 A 4/1979 Heimdal et al.
4,169,584 A 10/1979 Mangalick
4,191,486 A 3/1980 Pelton
4,192,011 A 3/1980 Cooper et al.
4,213,091 A 7/1980 Cooper
4,213,176 A 7/1980 Cooper
4,213,742 A 7/1980 Henshaw
4,219,882 A 8/1980 Cooper et al.
4,242,039 A 12/1980 Villard et al.
4,244,423 A 1/1981 Thut et al.
4,286,985 A 9/1981 van Linden et al.
4,305,214 A 12/1981 Hurst
4,322,245 A 3/1982 Claxton
4,338,062 A 7/1982 Neal
4,347,041 A 8/1982 Cooper
4,351,514 A 9/1982 Koch
4,355,789 A 10/1982 Dolzhenkov et al.
4,356,940 A 11/1982 Ansorge
4,360,314 A 11/1982 Pennell
4,370,096 A 1/1983 Church
4,372,541 A 2/1983 Bocourt et al.
4,375,937 A 3/1983 Cooper
4,389,159 A 6/1983 Sarvanne
4,392,888 A 7/1983 Eckert et al.
4,410,299 A 10/1983 Shimoyama
4,419,049 A 12/1983 Gerboth et al.
4,456,424 A 6/1984 Araoka
4,456,974 A 6/1984 Cooper
4,470,846 A 9/1984 Dube
4,474,315 A 10/1984 Gilbert et al.
4,489,475 A 12/1984 Struttmann
4,496,393 A 1/1985 Lustenberger
4,504,392 A 3/1985 Groteke
4,509,979 A 4/1985 Bauer
4,537,624 A 8/1985 Tenhover et al.
4,537,625 A 8/1985 Tenhover et al.
4,545,887 A 10/1985 Amesen
4,556,419 A 12/1985 Otsuka et al.
4,557,766 A 12/1985 Tenhover et al.
4,586,845 A 5/1986 Morris
4,592,700 A 6/1986 Toguchi et al.
4,593,597 A 6/1986 Albrecht et al.
4,594,052 A 6/1986 Niskanen
4,596,510 A 6/1986 Arneth et al.
4,598,899 A 7/1986 Cooper
4,600,222 A 7/1986 Appling
4,607,825 A 8/1986 Briolle et al.
4,609,442 A 9/1986 Tenhover et al.
4,611,790 A 9/1986 Otsuka et al.
4,617,232 A 10/1986 Chandler et al.
4,634,105 A 1/1987 Withers et al.
4,640,666 A 2/1987 Sodergard
4,651,806 A 3/1987 Allen et al.
4,655,610 A 4/1987 Al-Jaroudi
4,673,434 A 6/1987 Withers et al.
4,682,585 A 7/1987 Hiltelbrandt
4,684,281 A 8/1987 Patterson
4,685,822 A 8/1987 Pelton
4,696,703 A 9/1987 Henderson et al.
4,701,226 A 10/1987 Henderson et al.
4,702,768 A 10/1987 Areauz et al.
4,714,371 A 12/1987 Cuse
4,717,540 A 1/1988 McRae et al.
4,739,974 A 4/1988 Mordue
4,743,428 A 5/1988 McRae et al.
4,747,583 A 5/1988 Gordon et al.
4,767,230 A 8/1988 Leas, Jr.
4,770,701 A 9/1988 Henderson et al.
4,786,230 A 11/1988 Thut
4,802,656 A 2/1989 Hudault et al.
4,804,168 A 2/1989 Otsuka et al.
4,810,314 A 3/1989 Henderson et al.
4,822,473 A 4/1989 Arnesen
4,834,573 A 5/1989 Asano et al.
4,842,227 A 6/1989 Harrington et al.
4,844,425 A 7/1989 Piras et al.
4,851,296 A 7/1989 Tenhover et al.
4,859,413 A 8/1989 Harris et al.
4,860,819 A 8/1989 Moscoe et al.
4,867,638 A 9/1989 Handtmann et al.
4,884,786 A 12/1989 Gillespie
4,898,367 A 2/1990 Cooper

(56) References Cited

U.S. PATENT DOCUMENTS 4,908,060 A 3/1990 Duenkelmann
4,911,726 A 3/1990 Warkentin
4,923,770 A 5/1990 Grasselli et al.
4,930,986 A 6/1990 Cooper
4,931,091 A 6/1990 Waite et al.
4,940,214 A 7/1990 Gillespie
4,940,384 A 7/1990 Amra et al.
4,954,167 A 9/1990 Cooper
4,973,433 A 11/1990 Gilbert et al.
4,986,736 A 1/1991 Kajiwara
4,989,736 A 2/1991 Andersson et al.
5,006,232 A 4/1991 Lidgitt et al.
5,015,518 A 5/1991 Sasaki et al.
5,025,198 A 6/1991 Mordue et al.
5,028,211 A 7/1991 Mordue et al.
5,029,821 A 7/1991 Bar-on et al.
5,049,841 A 9/1991 Cooper et al.
5,058,654 A 10/1991 Simmons
5,078,572 A 1/1992 Amra et al.
5,080,715 A 1/1992 Provencher et al.
5,083,753 A 1/1992 Soofi
5,088,893 A 2/1992 Gilbert et al.
5,092,821 A 3/1992 Gilbert et al.
5,098,134 A 3/1992 Monckton
5,099,554 A 3/1992 Cooper
5,114,312 A 5/1992 Stanislao
5,126,047 A 6/1992 Martin et al.
5,131,632 A 7/1992 Olson
5,135,202 A 8/1992 Yamashita et al.
5,143,357 A 9/1992 Gilbert et al.
5,145,322 A 9/1992 Senior, Jr. et al.
5,152,631 A 10/1992 Bauer
5,154,652 A 10/1992 Ecklesdafer
5,158,440 A 10/1992 Cooper et al.
5,162,858 A 11/1992 Shoji et al.
5,165,858 A 11/1992 Gilbert et al.
5,172,458 A 12/1992 Cooper
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,303,903 A 4/1994 Butler et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,383,651 A 1/1995 Blasen et al.
5,388,633 A 2/1995 Mercer, II et al.
5,395,405 A 3/1995 Nagel et al.
5,399,074 A 3/1995 Nose et al.
5,407,294 A 4/1995 Giannini
5,411,240 A 5/1995 Rapp et al.
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,494,382 A 2/1996 Kloppers
5,495,746 A 3/1996 Sigworth
5,505,143 A 4/1996 Nagel
5,505,435 A 4/1996 Laszlo
5,509,791 A 4/1996 Turner
5,511,766 A 4/1996 Vassillicos
5,520,422 A 5/1996 Friedrich
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A 9/1996 Mordue et al.
5,571,486 A 11/1996 Robert et al.
5,585,532 A 12/1996 Nagel
5,586,863 A 12/1996 Gilbert et al.
5,591,243 A 1/1997 Colussi et al.
5,597,289 A 1/1997 Thut
5,613,245 A 3/1997 Robert
5,616,167 A 4/1997 Eckert
5,622,481 A 4/1997 Thut
5,629,464 A 5/1997 Bach et al.
5,634,770 A 6/1997 Gilbert et al.
5,640,706 A 6/1997 Nagel et al.
5,640,707 A 6/1997 Nagel et al.
5,640,709 A 6/1997 Nagel et al.
5,655,849 A 8/1997 McEwen et al.
5,660,614 A 8/1997 Waite et al.
5,662,725 A 9/1997 Cooper
5,676,520 A 10/1997 Thut
5,678,244 A 10/1997 Shaw et al.
5,678,807 A 10/1997 Cooper
5,679,132 A 10/1997 Rauenzahn et al.
5,685,701 A 11/1997 Chandler et al.
5,690,888 A 11/1997 Robert
5,695,732 A 12/1997 Sparks et al.
5,716,195 A 2/1998 Thut
5,717,149 A 2/1998 Nagel et al.
5,718,416 A 2/1998 Flisakowski et al.
5,735,668 A 4/1998 Klien
5,735,935 A 4/1998 Areaux
5,741,422 A 4/1998 Eichenmiller et al.
5,744,117 A 4/1998 Wilikinson et al.
5,745,861 A 4/1998 Bell et al.
5,755,847 A 5/1998 Quayle
5,772,324 A 6/1998 Falk
5,776,420 A 7/1998 Nagel
5,785,494 A 7/1998 Vild et al.
5,805,067 A 9/1998 Bradley et al.
5,810,311 A 9/1998 Davison et al.
5,842,832 A 12/1998 Thut
5,846,481 A 12/1998 Tilak
5,858,059 A 1/1999 Abramovich et al.
5,863,314 A 1/1999 Morando
5,864,316 A 1/1999 Bradley et al.
5,866,095 A 2/1999 McGeever et al.
5,875,385 A 2/1999 Stephenson et al.
5,935,528 A 8/1999 Stephenson et al.
5,944,496 A 8/1999 Cooper
5,947,705 A 9/1999 Mordue et al.
5,948,352 A 9/1999 Jagt
5,949,369 A 9/1999 Bradley et al.
5,951,243 A 9/1999 Cooper
5,961,285 A 10/1999 Meneice et al.
5,963,580 A 10/1999 Eckert
5,992,230 A 11/1999 Scarpa et al.
5,993,726 A 11/1999 Huang
5,993,728 A 11/1999 Vild
5,995,041 A 11/1999 Bradley et al.
6,019,576 A 2/2000 Thut
6,024,286 A 2/2000 Bradley et al.
6,027,685 A 2/2000 Cooper
6,036,745 A 3/2000 Gilbert et al.
6,074,455 A 6/2000 Van Linden et al.
6,082,965 A 7/2000 Morando
6,093,000 A 7/2000 Cooper
6,096,109 A 8/2000 Nagel et al.
6,113,154 A 9/2000 Thut

(56) References Cited

U.S. PATENT DOCUMENTS 6,123,523 A 9/2000 Cooper
6,152,691 A 11/2000 Thut
6,168,753 B1 1/2001 Morando
6,187,096 B1 2/2001 Thut
6,199,836 B1 3/2001 Rexford et al.
6,217,823 B1 4/2001 Vild et al.
6,231,639 B1 5/2001 Eichenmiller
6,243,366 B1 6/2001 Bradley et al.
6,250,881 B1 6/2001 Mordue et al.
6,254,340 B1 7/2001 Vild et al.
6,270,717 B1 8/2001 Tremblay et al.
6,280,157 B1 8/2001 Cooper
6,293,759 B1 9/2001 Thut
6,303,074 B1 10/2001 Cooper
6,345,964 B1 2/2002 Cooper
6,354,796 B1 3/2002 Morando
6,358,467 B1 3/2002 Mordue
6,364,930 B1 4/2002 Kos
6,371,723 B1 4/2002 Grant et al.
6,398,525 B1 6/2002 Cooper
6,439,860 B1 8/2002 Greer
6,451,247 B1 9/2002 Mordue et al.
6,457,940 B1 10/2002 Lehman
6,457,950 B1 10/2002 Cooper et al.
6,464,458 B2 10/2002 Vild et al.
6,495,948 B1 12/2002 Garrett, III
6,497,559 B1 12/2002 Grant
6,500,228 B1 12/2002 Klingensmith et al.
6,503,292 B2 1/2003 Klingensmith et al.
6,524,066 B2 2/2003 Thut
6,533,535 B2 3/2003 Thut
6,551,060 B2 4/2003 Mordue et al.
6,562,286 B1 5/2003 Lehman
6,648,026 B2 11/2003 Look et al.
6,656,415 B2 12/2003 Kos
6,679,936 B2 1/2004 Quackenbush
6,689,310 B1 2/2004 Cooper
6,695,510 B1 2/2004 Look et al.
6,709,234 B2 3/2004 Gilbert et al.
6,716,147 B1 4/2004 Hinkle et al.
6,723,276 B1 4/2004 Cooper
6,805,834 B2 10/2004 Thut
6,843,640 B2 1/2005 Mordue et al.
6,848,497 B2 2/2005 Sale et al.
6,869,271 B2 3/2005 Gilbert et al.
6,869,564 B2 3/2005 Gilbert et al.
6,881,030 B2 4/2005 Thut
6,887,424 B2 5/2005 Ohno et al.
6,887,425 B2 5/2005 Mordue et al.
6,902,696 B2 6/2005 Klingensmith et al.
6,955,489 B2 10/2005 Thut
7,037,462 B2 5/2006 Klingensmith et al.
7,056,322 B2 6/2006 Davison et al.
7,074,361 B2 7/2006 Carolla
7,083,758 B2 8/2006 Tremblay
7,131,482 B2 11/2006 Vincent et al.
7,157,043 B2 1/2007 Neff
7,204,954 B2 4/2007 Mizuno
7,273,582 B2 9/2007 Mordue
7,279,128 B2 10/2007 Kennedy et al.
7,326,028 B2 2/2008 Morando
7,402,276 B2 7/2008 Cooper
7,470,392 B2 12/2008 Cooper
7,476,357 B2 1/2009 Thut
7,481,966 B2 1/2009 Mizuno
7,497,988 B2 3/2009 Thut
7,507,365 B2 3/2009 Thut
7,507,367 B2 3/2009 Cooper
7,543,605 B1 6/2009 Morando
7,731,891 B2 6/2010 Cooper
7,771,171 B2 8/2010 Mohr
7,896,617 B1 3/2011 Morando
7,906,068 B2 3/2011 Cooper
8,075,837 B2 12/2011 Cooper
8,110,141 B2 2/2012 Cooper
8,137,023 B2 3/2012 Greer
8,142,145 B2 3/2012 Thut
8,178,037 B2 5/2012 Cooper
8,328,540 B2 12/2012 Wang
8,333,921 B2 12/2012 Thut
8,337,746 B2 12/2012 Cooper
8,361,379 B2 1/2013 Cooper
8,366,993 B2 2/2013 Cooper
8,409,495 B2 4/2013 Cooper
8,440,135 B2 5/2013 Cooper
8,444,911 B2 5/2013 Cooper
8,449,814 B2 5/2013 Cooper
8,475,594 B2 7/2013 Bright et al.
8,475,708 B2 7/2013 Cooper
8,480,950 B2 7/2013 Jetten et al.
8,501,084 B2 8/2013 Cooper
8,524,146 B2 9/2013 Cooper
8,529,828 B2 9/2013 Cooper
8,535,603 B2 9/2013 Cooper
8,580,218 B2 11/2013 Turenne et al.
8,613,884 B2 12/2013 Cooper
8,714,914 B2 5/2014 Cooper
8,753,563 B2 6/2014 Cooper
8,840,359 B2 9/2014 Vick et al.
8,899,932 B2 12/2014 Tetkoskie et al.
8,915,830 B2 12/2014 March et al.
8,920,680 B2 12/2014 Mao
9,011,761 B2 4/2015 Cooper
9,017,597 B2 4/2015 Cooper
9,034,244 B2 5/2015 Cooper
9,057,376 B2 6/2015 Thut
9,074,601 B1 7/2015 Thut
9,080,577 B2 7/2015 Cooper
9,108,224 B2 8/2015 Schererz
9,108,244 B2 8/2015 Cooper
9,156,087 B2 10/2015 Cooper
9,193,532 B2 11/2015 March et al.
9,205,490 B2 12/2015 Cooper
9,234,520 B2 1/2016 Morando
9,273,376 B2 3/2016 Lutes et al.
9,328,615 B2 5/2016 Cooper
9,377,028 B2 6/2016 Cooper
9,382,599 B2 7/2016 Cooper
9,383,140 B2 7/2016 Cooper
9,409,232 B2 8/2016 Cooper
9,410,744 B2 8/2016 Cooper
9,422,942 B2 8/2016 Cooper
9,435,343 B2 9/2016 Cooper
9,464,636 B2 10/2016 Cooper
9,470,239 B2 10/2016 Cooper
9,476,644 B2 10/2016 Howitt et al.
9,481,035 B2 11/2016 Cooper
9,481,918 B2 11/2016 Vild et al.
9,482,469 B2 11/2016 Cooper
9,494,366 B1 11/2016 Thut
9,506,129 B2 11/2016 Cooper
9,506,346 B2 11/2016 Bright et al.
9,566,645 B2 2/2017 Cooper
9,581,388 B2 2/2017 Cooper
9,587,883 B2 3/2017 Cooper
9,657,578 B2 5/2017 Cooper
9,855,600 B2 1/2018 Cooper
9,862,026 B2 1/2018 Cooper
9,903,383 B2 2/2018 Cooper
9,909,808 B2 3/2018 Cooper
9,925,587 B2 3/2018 Cooper
9,951,777 B2 4/2018 Morando et al.
9,970,442 B2 5/2018 Tipton
9,982,945 B2 5/2018 Cooper
10,052,688 B2 8/2018 Cooper
10,072,897 B2 9/2018 Cooper
10,126,058 B2 11/2018 Cooper
10,126,059 B2 11/2018 Cooper
10,138,892 B2 11/2018 Cooper
10,195,664 B2 2/2019 Cooper et al.
10,267,314 B2 4/2019 Cooper
10,274,256 B2 4/2019 Cooper
10,302,361 B2 5/2019 Cooper
10,307,821 B2 6/2019 Cooper

(56) References Cited

U.S. PATENT DOCUMENTS 10,309,725 B2 6/2019 Cooper
10,322,451 B2 6/2019 Cooper
10,345,045 B2 7/2019 Cooper
10,352,620 B2 7/2019 Cooper
10,428,821 B2 10/2019 Cooper
10,465,688 B2 11/2019 Cooper
10,562,097 B2 * 2/2020 Cooper ..... B22D 37/00
10,570,745 B2 2/2020 Cooper
10,641,270 B2 5/2020 Cooper
2001/0000465 A1 4/2001 Thut
2001/0012758 A1 8/2001 Bradley et al.
2002/0089099 A1 7/2002 Denning
2002/0146313 A1 10/2002 Thut
2002/0185790 A1 12/2002 Klingensmith
2002/0185794 A1 12/2002 Vincent
2002/0187947 A1 12/2002 Jarai et al.
2003/0047850 A1 3/2003 Areaux
2003/0075844 A1 4/2003 Mordue et al.
2003/0082052 A1 5/2003 Gilbert et al.
2003/0151176 A1 8/2003 Ohno
2003/0201583 A1 10/2003 Klingensmith
2004/0050525 A1 3/2004 Kennedy et al.
2004/0076533 A1 4/2004 Cooper
2004/0115079 A1 6/2004 Cooper
2004/0199435 A1 10/2004 Abrams et al.
2004/0262825 A1 12/2004 Cooper
2005/0013713 A1 1/2005 Cooper
2005/0013714 A1 1/2005 Cooper
2005/0013715 A1 1/2005 Cooper
2005/0053499 A1 3/2005 Cooper
2005/0077730 A1 4/2005 Thut
2005/0081607 A1 4/2005 Patel et al.
2005/0116398 A1 6/2005 Tremblay
2006/0180963 A1 8/2006 Thut
2007/0253807 A1 11/2007 Cooper
2008/0202644 A1 8/2008 Grassi
2008/0211147 A1 9/2008 Cooper
2008/0213111 A1 9/2008 Cooper
2008/0230966 A1 9/2008 Cooper
2008/0253905 A1 10/2008 Morando et al.
2008/0304970 A1 12/2008 Cooper
2008/0314548 A1 12/2008 Cooper
2009/0054167 A1 2/2009 Cooper
2009/0269191 A1 10/2009 Cooper
2010/0104415 A1 4/2010 Morando
2010/0200354 A1 8/2010 Yagi et al.
2011/0133374 A1 6/2011 Cooper
2011/0140319 A1 6/2011 Cooper
2011/0140619 A1 6/2011 Cooper
2011/0142603 A1 6/2011 Cooper
2011/0142606 A1 6/2011 Cooper
2011/0148012 A1 6/2011 Cooper
2011/0163486 A1 7/2011 Cooper
2011/0210232 A1 9/2011 Cooper
2011/0220771 A1 9/2011 Cooper
2011/0303706 A1 12/2011 Cooper
2012/0003099 A1 1/2012 Tetkoskie
2012/0163959 A1 6/2012 Morando
2013/0105102 A1 5/2013 Cooper
2013/0142625 A1 6/2013 Cooper
2013/0214014 A1 8/2013 Cooper
2013/0224038 A1 8/2013 Tetkoskie et al.
2013/0292426 A1 * 11/2013 Cooper ..... B22D 39/00 222/590
2013/0292427 A1 11/2013 Cooper
2013/0299524 A1 * 11/2013 Cooper ..... B22D 7/00 222/590
2013/0299525 A1 * 11/2013 Cooper ..... B22D 37/00 222/590
2013/0306687 A1 * 11/2013 Cooper ..... B22D 37/00 222/594
2013/0334744 A1 12/2013 Tremblay
2013/0343904 A1 12/2013 Cooper
2014/0008849 A1 1/2014 Cooper
2014/0041252 A1 2/2014 Vild et al.
2014/0044520 A1 2/2014 Tipton
2014/0083253 A1 3/2014 Lutes et al.
2014/0210144 A1 7/2014 Torres et al.
2014/0232048 A1 8/2014 Howitt et al.
2014/0252701 A1 9/2014 Cooper
2014/0261800 A1 9/2014 Cooper
2014/0263482 A1 9/2014 Cooper
2014/0265068 A1 9/2014 Cooper
2014/0271219 A1 9/2014 Cooper
2014/0363309 A1 12/2014 Henderson et al.
2015/0069679 A1 3/2015 Henderson et al.
2015/0192364 A1 7/2015 Cooper
2015/0217369 A1 8/2015 Cooper
2015/0219111 A1 8/2015 Cooper
2015/0219112 A1 8/2015 Cooper
2015/0219113 A1 8/2015 Cooper
2015/0219114 A1 8/2015 Cooper
2015/0224574 A1 8/2015 Cooper
2015/0252807 A1 9/2015 Cooper
2015/0285558 A1 10/2015 Cooper
2015/0323256 A1 11/2015 Cooper
2015/0328682 A1 11/2015 Cooper
2015/0328683 A1 11/2015 Cooper
2016/0031007 A1 2/2016 Cooper
2016/0040265 A1 2/2016 Cooper
2016/0047602 A1 2/2016 Cooper
2016/0053762 A1 2/2016 Cooper
2016/0053814 A1 2/2016 Cooper
2016/0082507 A1 3/2016 Cooper
2016/0089718 A1 3/2016 Cooper
2016/0091251 A1 3/2016 Cooper
2016/0116216 A1 4/2016 Schlicht et al.
2016/0221855 A1 8/2016 Retorick et al.
2016/0250686 A1 9/2016 Cooper
2016/0265535 A1 9/2016 Cooper
2016/0305711 A1 10/2016 Cooper
2016/0320129 A1 11/2016 Cooper
2016/0320130 A1 11/2016 Cooper
2016/0320131 A1 11/2016 Cooper
2016/0346836 A1 12/2016 Henderson et al.
2016/0348973 A1 12/2016 Cooper
2016/0348974 A1 12/2016 Cooper
2016/0348975 A1 12/2016 Cooper
2017/0037852 A1 2/2017 Bright et al.
2017/0038146 A1 2/2017 Cooper
2017/0045298 A1 2/2017 Cooper
2017/0056973 A1 3/2017 Tremblay et al.
2017/0082368 A1 3/2017 Cooper
2017/0106435 A1 4/2017 Vincent
2017/0167793 A1 6/2017 Cooper et al.
2017/0198721 A1 7/2017 Cooper
2017/0219289 A1 8/2017 Williams et al.
2017/0241713 A1 8/2017 Henderson et al.
2017/0246681 A1 8/2017 Tipton et al.
2017/0276430 A1 9/2017 Cooper
2018/0058465 A1 3/2018 Cooper
2018/0111189 A1 4/2018 Cooper
2018/0178281 A1 6/2018 Cooper
2018/0195513 A1 7/2018 Cooper
2018/0311726 A1 11/2018 Cooper
2019/0032675 A1 1/2019 Cooper
2019/0270134 A1 9/2019 Cooper
2019/0293089 A1 9/2019 Cooper
2019/0351481 A1 11/2019 Tetkoskie et al.
2019/0360491 A1 11/2019 Cooper
2019/0360492 A1 11/2019 Cooper
2019/0368494 A1 12/2019 Cooper
2020/0130050 A1 * 4/2020 Cooper ..... B22D 41/00
2020/0130051 A1 4/2020 Cooper
2020/0130052 A1 4/2020 Cooper
2020/0130053 A1 4/2020 Cooper
2020/0130054 A1 4/2020 Cooper
2020/0182247 A1 6/2020 Cooper
2020/0182248 A1 6/2020 Cooper

FOREIGN PATENT DOCUMENTS

CA 2244251 12/1996
CA 2305865 2/2000

(56) References Cited

FOREIGN PATENT DOCUMENTS

| | | |
|---|---|---|
| CA | 2176475 | 7/2005 |
| CA | 2924572 | 4/2015 |
| CH | 392268 | 9/1965 |
| DE | 1800446 | 12/1969 |
| EP | 168250 | 1/1986 |
| EP | 665378 | 2/1995 |
| EP | 1019635 | 6/2006 |
| GB | 543607 | 3/1942 |
| GB | 942648 | 11/1963 |
| GB | 1185314 | 3/1970 |
| GB | 2217784 | 3/1989 |
| JP | 58048796 | 3/1983 |
| JP | 63104773 | 5/1988 |
| JP | 5112837 | 5/1993 |
| JP | 11-270799 | 10/1999 |
| MX | 227385 | 4/2005 |
| NO | 90756 | 1/1959 |
| SU | 416401 | 2/1974 |
| SU | 773312 | 10/1980 |
| WO | 199808990 | 3/1998 |
| WO | 199825031 | 6/1998 |
| WO | 200009889 | 2/2000 |
| WO | 2002012147 | 2/2002 |
| WO | 2004029307 | 4/2004 |
| WO | 2010147932 | 12/2010 |
| WO | 2014055082 | 4/2014 |
| WO | 2014150503 | 9/2014 |
| WO | 2014185971 | 11/2014 |

OTHER PUBLICATIONS

Document No. 504217: Excerpts from "Pyrotek Inc.'s Motion for Summary Judgment of Invalidity and Unenforceability of U.S. Pat. No. 7,402,276," Oct. 2, 2009.

Document No. 505026: Excerpts from "MMEI's Response to Pyrotek's Motion for Summary Judgment of Invalidity or Enforceability of U.S. Pat. No. 7,402,276," Oct. 9, 2009.

Document No. 507689: Excerpts from "MMEI's Pre-Hearing Brief and Supplemental Motion for Summary Judgment of Infringement of Claims 3-4, 15, 17-20, 26 and 28-29 of the '074 Patent and Motion for Reconsideration of the Validity of Claims 7-9 of the '276 Patent," Nov. 4, 2009.

Document No. 517158: Excerpts from "Reasoned Award," Feb. 19, 2010.

Document No. 525055: Excerpts from "Molten Metal Equipment Innovations, Inc.'s Reply Brief in Support of Application to Confirm Arbitration Award and Opposition to Motion to Vacate," May 12, 2010.

USPTO; Office Action dated Feb. 23, 1996 in U.S. Appl. No. 08/439,739.

USPTO; Office Action dated Aug. 15, 1996 in U.S. Appl. No. 08/439,739.

USPTO; Advisory Action dated Nov. 18, 1996 in U.S. Appl. No. 08/439,739.

USPTO; Advisory Action dated Dec. 9, 1996 in U.S. Appl. No. 08/439,739.

USPTO; Notice of Allowance dated Jan. 17, 1997 in U.S. Appl. No. 08/439,739.

USPTO; Office Action dated Jul. 22, 1996 in U.S. Appl. No. 08/489,962.

USPTO; Office Action dated Jan. 6, 1997 in U.S. Appl. No. 08/489,962.

USPTO; Interview Summary dated Mar. 4, 1997 in U.S. Appl. No. 08/489,962.

USPTO; Notice of Allowance dated Mar. 27, 1997 in U.S. Appl. No. 08/489,962.

USPTO; Office Action dated Sep. 23, 1998 in U.S. Appl. No. 08/759,780.

USPTO; Interview Summary dated Dec. 30, 1998 in U.S. Appl. No. 08/789,780.

USPTO; Notice of Allowance dated Mar. 17, 1999 in U.S. Appl. No. 08/789,780.

USPTO; Office Action dated Jul. 23, 1998 in U.S. Appl. No. 08/889,882.

USPTO; Office Action dated Jan. 21, 1999 in U.S. Appl. No. 08/889,882.

USPTO; Notice of Allowance dated Mar. 17, 1999 in U.S. Appl. No. 08/889,882.

USPTO; Office Action dated Feb. 26, 1999 in U.S. Appl. No. 08/951,007.

USPTO; Interview Summary dated Mar. 15, 1999 in U.S. Appl. No. 08/951,007.

USPTO; Office Action dated May 17, 1999 in U.S. Appl. No. 08/951,007.

USPTO; Notice of Allowance dated Aug. 27, 1999 in U.S. Appl. No. 08/951,007.

USPTO; Office Action dated Dec. 23, 1999 in U.S. Appl. No. 09/132,934.

USPTO; Notice of Allowance dated Mar. 9, 2000 in U.S. Appl. No. 09/132,934.

USPTO; Office Action dated Jan. 7, 2000 in U.S. Appl. No. 09/152,168.

USPTO; Notice of Allowance dated Aug. 7, 2000 in U.S. Appl. No. 09/152,168.

USPTO; Office Action dated Sep. 29, 1999 in U.S. Appl. No. 09/275,627.

USPTO; Office Action dated May 22, 2000 in U.S. Appl. No. 09/275,627.

USPTO; Office Action dated Nov. 14, 2000 in U.S. Appl. No. 09/275,627.

USPTO; Office Action dated May 21, 2001 in U.S. Appl. No. 09/275,627.

USPTO; Notice of Allowance dated Aug. 31, 2001 in U.S. Appl. No. 09/275,627.

USPTO; Office Action dated Jun. 15, 2000 in U.S. Appl. No. 09/312,361.

USPTO; Notice of Allowance dated Jan. 29, 2001 in U.S. Appl. No. 09/312,361.

USPTO; Office Action dated Jun. 22, 2001 in U.S. Appl. No. 09/569,461.

USPTO; Office Action dated Oct. 12, 2001 in U.S. Appl. No. 09/569,461.

USPTO; Office Action dated May 3, 2002 in U.S. Appl. No. 09/569,461.

USPTO; Advisory Action dated May 14, 2002 in U.S. Appl. No. 09/569,461.

USPTO; Office Action dated Dec. 4, 2002 in U.S. Appl. No. 09/569,461.

USPTO; Interview Summary dated Jan. 14, 2003 in U.S. Appl. No. 09/569,461.

USPTO; Notice of Allowance dated Jun. 24, 2003 in U.S. Appl. No. 09/569,461.

USPTO; Office Action dated Nov. 21, 2000 in U.S. Appl. No. 09/590,108.

USPTO; Office Action dated May 22, 2001 in U.S. Appl. No. 09/590,108.

USPTO; Notice of Allowance dated Sep. 10, 2001 in U.S. Appl. No. 09/590,108.

USPTO; Office Action dated Jan. 30, 2002 in U.S. Appl. No. 09/649,190.

USPTO; Office Action dated Oct. 4, 2002 in U.S. Appl. No. 09/649,190.

USPTO; Office Action dated Apr. 18, 2003 in U.S. Appl. No. 09/649,190.

USPTO; Notice of Allowance dated Nov. 21, 2003 in U.S. Appl. No. 09/649,190.

USPTO; Office Action dated Jun. 7, 2006 in U.S. Appl. No. 10/619,405.

USPTO; Final Office Action dated Feb. 20, 2007 in U.S. Appl. No. 10/619,405.

USPTO; Office Action dated Oct. 9, 2007 in U.S. Appl. No. 10/619,405.

(56) References Cited

OTHER PUBLICATIONS

USPTO; Final Office Action dated May 29, 2008 in U.S. Appl. No. 10/619,405.
USPTO; Interview Summary dated Aug. 22, 2008 in U.S. Appl. No. 10/619,405.
USPTO; Ex Parte Quayle dated Sep. 12, 2008 in U.S. Appl. No. 10/619,405.
USPTO; Interview Summary dated Oct. 16, 2008 in U.S. Appl. No. 10/619,405.
USPTO; Notice of Allowance dated Nov. 14, 2008 in U.S. Appl. No. 10/619,405.
USPTO; Office Action dated Mar. 20, 2006 in U.S. Appl. No. 10/620,318.
USPTO; Office Action dated Nov. 16, 2006 in U.S. Appl. No. 10/620,318.
USPTO; Final Office Action dated Jul. 25, 2007 in U.S. Appl. No. 10/620,318.
USPTO; Office Action dated Feb. 12, 2008 in U.S. Appl. No. 10/620,318.
USPTO; Final Office Action dated Oct. 16, 2008 in U.S. Appl. No. 10/620,318.
USPTO; Office Action dated Feb. 25, 2009 in U.S. Appl. No. 10/620,318.
USPTO; Final Office Action dated Oct. 8, 2009 in U.S. Appl. No. 10/620,318.
USPTO; Notice of Allowance Jan. 26, 2010 in U.S. Appl. No. 10/620,318.
USPTO; Office Action dated Nov. 15, 2007 in U.S. Appl. No. 10/773,101.
USPTO; Office Action dated Jun. 27, 2006 in U.S. Appl. No. 10/773,102.
USPTO; Final Office Action dated Mar. 6, 2007 in U.S. Appl. No. 10/773,102.
USPTO; Office Action dated Oct. 11, 2007 in U.S. Appl. No. 10/773,102.
USPTO; Interview Summary dated Mar. 18, 2008 in U.S. Appl. No. 10/773,102.
USPTO; Notice of Allowance dated Apr. 18, 2008 in U.S. Appl. No. 10/773,102.
USPTO; Office Action dated Jul. 24, 2006 in U.S. Appl. No. 10/773,105.
USPTO; Final Office Action dated Jul. 21, 2007 in U.S. Appl. No. 10/773,105.
USPTO; Office Action dated Oct. 9, 2007 in U.S. Appl. No. 10/773,105.
USPTO; Interview Summary dated Jan. 25, 2008 in U.S. Appl. No. 10/773,105.
USPTO; Office Action dated May 19, 2008 in U.S. Appl. No. 10/773,105.
USPTO; Interview Summary dated Jul. 21, 2008 in U.S. Appl. No. 10/773,105.
USPTO; Notice of Allowance dated Sep. 29, 2008 in U.S. Appl. No. 10/773,105.
USPTO; Office Action dated Jan. 31, 2008 in U.S. Appl. No. 10/773,118.
USPTO; Final Office Action dated Aug. 18, 2008 in U.S. Appl. No. 10/773,118.
USPTO; Interview Summary dated Oct. 16, 2008 in U.S. Appl. No. 10/773,118.
USPTO; Office Action dated Dec. 15, 2008 in U.S. Appl. No. 10/773,118.
USPTO; Final Office Action dated May 1, 2009 in U.S. Appl. No. 10/773,118.
USPTO; Office Action dated Jul. 27, 2009 in U.S. Appl. No. 10/773,118.
USPTO; Final Office Action dated Feb. 2, 2010 in U.S. Appl. No. 10/773,118.
USPTO; Interview Summary dated Jun. 4, 2010 in U.S. Appl. No. 10/773,118.
USPTO; Ex Parte Quayle Action dated Aug. 25, 2010 in U.S. Appl. No. 10/773,118.
USPTO; Notice of Allowance dated Nov. 5, 2010 in U.S. Appl. No. 10/773,118.
USPTO; Office Action dated Mar. 16, 2005 in U.S. Appl. No. 10/827,941.
USPTO; Final Office Action dated Nov. 7, 2005 in U.S. Appl. No. 10/827,941.
USPTO; Office Action dated Jul. 12, 2006 in U.S. Appl. No. 10/827,941.
USPTO; Final Office Action dated Mar. 8, 2007 in U.S. Appl. No. 10/827,941.
USPTO; Office Action dated Oct. 29, 2007 in U.S. Appl. No. 10/827,941.
USPTO; Office Action dated Sep. 26, 2008 in U.S. Appl. No. 11/413,982.
USPTO; Office Action dated Dec. 11, 2009 in U.S. Appl. No. 11/766,617.
USPTO; Office Action dated Mar. 8, 2010 in U.S. Appl. No. 11/766,617.
USPTO; Final Office Action dated Sep. 20, 2010 in U.S. Appl. No. 11/766,617.
USPTO; Office Action dated Mar. 1, 2011 in U.S. Appl. No. 11/766,617.
USPTO; Final Office Action dated Sep. 22, 2011 in U.S. Appl. No. 11/766,617.
USPTO; Office Action dated Jan. 27, 2012 in U.S. Appl. No. 11/766,617.
USPTO; Notice of Allowance dated May 15, 2012 in U.S. Appl. No. 11/766,617.
USPTO; Supplemental Notice of Allowance dated Jul. 31, 2012 in U.S. Appl. No. 11/766,617.
USPTO; Notice of Allowance dated Aug. 24, 2012 in U.S. Appl. No. 11/766,617.
USPTO; Final Office Action dated Oct. 14, 2008 in U.S. Appl. No. 12/111,835.
USPTO; Office Action dated May 15, 2009 in U.S. Appl. No. 12/111,835.
USPTO; Office Action dated Mar. 31, 2009 in U.S. Appl. No. 12/120,190.
USPTO; Final Office Action dated Dec. 4, 2009 in U.S. Appl. No. 12/120,190.
USPTO; Office Action dated Jun. 28, 2010 in U.S. Appl. No. 12/120,190.
USPTO; Final Office Action dated Jan. 6, 2011 in U.S. Appl. No. 12/120,190.
USPTO; Office Action dated Jun. 27, 2011 in U.S. Appl. No. 12/120,190.
USPTO; Final Office Action dated Nov. 28, 2011 in U.S. Appl. No. 12/120,190.
USPTO; Notice of Allowance dated Feb. 6, 2012 in U.S. Appl. No. 12/120,190.
USPTO; Office Action dated Nov. 3, 2008 in U.S. Appl. No. 12/120,200.
USPTO; Final Office Action dated May 28, 2009 in U.S. Appl. No. 12/120,200.
USPTO; Office Action dated Dec. 18, 2009 in U.S. Appl. No. 12/120,200.
USPTO; Final Office Action dated Jul. 9, 2010 in U.S. Appl. No. 12/120,200.
USPTO; Office Action dated Jan. 21, 2011 in U.S. Appl. No. 12/120,200.
USPTO; Final Office Action dated Jul. 26, 2011 in U.S. Appl. No. 12/120,200.
USPTO; Final Office Action dated Feb. 3, 2012 in U.S. Appl. No. 12/120,200.
USPTO; Notice of Allowance dated Jan. 17, 2013 in U.S. Appl. No. 12/120,200.
USPTO; Office Action dated Jun. 16, 2009 in U.S. Appl. No. 12/146,770.
USPTO; Final Office Action dated Feb. 24, 2010 in U.S. Appl. No. 12/146,770.

(56) References Cited

OTHER PUBLICATIONS

USPTO; Office Action dated Jun. 9, 2010 in U.S. Appl. No. 12/146,770.
USPTO; Office Action dated Nov. 18, 2010 in U.S. Appl. No. 12/146,770.
USPTO; Final Office Action dated Apr. 4, 2011 in U.S. Appl. No. 12/146,770.
USPTO; Notice of Allowance dated Aug. 22, 2011 in U.S. Appl. No. 12/146,770.
USPTO; Notice of Allowance dated Nov. 1, 2011 in U.S. Appl. No. 12/146,770.
USPTO; Office Action dated Apr. 27, 2009 in U.S. Appl. No. 12/146,788.
USPTO; Final Office Action dated Oct. 15, 2009 in U.S. Appl. No. 12/146,788.
USPTO; Office Action dated Feb. 16, 2010 in U.S. Appl. No. 12/146,788.
USPTO; Final Office Action dated Jul. 13, 2010 in U.S. Appl. No. 12/146,788.
USPTO; Office Action dated Apr. 19, 2011 in U.S. Appl. No. 12/146,788.
USPTO; Notice of Allowance dated Aug. 19, 2011 in U.S. Appl. No. 12/146,788.
USPTO; Office Action dated Apr. 13, 2009 in U.S. Appl. No. 12/264,416.
USPTO; Final Office Action dated Oct. 8, 2009 in U.S. Appl. No. 12/264,416.
USPTO; Office Action dated Feb. 1, 2010 in U.S. Appl. No. 12/264,416.
USPTO; Final Office Action dated Jun. 30, 2010 in U.S. Appl. No. 12/264,416.
USPTO; Office Action dated Mar. 17, 2011 in U.S. Appl. No. 12/264,416.
USPTO; Final Office Action dated Jul. 7, 2011 in U.S. Appl. No. 12/264,416.
USPTO; Office Action dated Nov. 4, 2011 in U.S. Appl. No. 12/264,416.
USPTO; Final Office Action dated Jun. 8, 2012 in U.S. Appl. No. 12/264,416.
USPTO; Office Action dated Nov. 28, 2012 in U.S. Appl. No. 12/264,416.
USPTO; Ex Parte Quayle dated Apr. 3, 2013 in U.S. Appl. No. 12/264,416.
USPTO; Notice of Allowance dated Jun. 23, 2013 in U.S. Appl. No. 12/264,416.
USPTO; Office Action dated May 22, 2009 in U.S. Appl. No. 12/369,362.
USPTO; Final Office Action dated Dec. 14, 2009 in U.S. Appl. No. 12/369,362.
USPTO; Final Office Action dated Jun. 11, 2010 in U.S. Appl. No. 12/395,430.
USPTO; Office Action dated Nov. 24, 2010 in U.S. Appl. No. 12/395,430.
USPTO; Final Office Action dated Apr. 6, 2011 in U.S. Appl. No. 12/395,430.
USPTO; Office Action dated Aug. 18, 2011 in U.S. Appl. No. 12/395,430.
USPTO; Final Office Action dated Dec. 13, 2011 in U.S. Appl. No. 12/395,430.
USPTO; Notice of Allowance dated Sep. 20, 2012 in U.S. Appl. No. 12/395,430.
USPTO; Advisory Action dated Feb. 22, 2012 in U.S. Appl. No. 12/395,430.
USPTO; Office Action dated Sep. 29, 2010 in U.S. Appl. No. 12/758,509.
USPTO; Final Office Action dated May 11, 2011 in U.S. Appl. No. 12/758,509.
USPTO; Office Action dated Feb. 1, 2012 in U.S. Appl. No. 12/853,201.
USPTO; Final Office Action dated Jul. 3, 2012 in U.S. Appl. No. 12/853,201.
USPTO; Notice of Allowance dated Jan. 31, 2013 in U.S. Appl. No. 12/853,201.
USPTO; Office Action dated Jan. 3, 2013 in U.S. Appl. No. 12/853,238.
USPTO; Office Action dated Dec. 18, 2013 in U.S. Appl. No. 12/853,238.
USPTO; Final Office Action dated May 19, 2014 in U.S. Appl. No. 12/853,238.
USPTO; Office Action dated Mar. 31, 2015 in U.S. Appl. No. 12/853,238.
USPTO; Office Action dated Jan. 20, 2016 in U.S. Appl. No. 12/853,238.
USPTO; Office Action dated Feb. 27, 2012 in U.S. Appl. No. 12/853,253.
USPTO; Ex Parte Quayle Action dated Jun. 27, 2012 in U.S. Appl. No. 12/853,253.
USPTO; Notice of Allowance dated Oct. 2, 2012 in U.S. Appl. No. 12/853,253.
USPTO; Office Action dated Mar. 12, 2012 in U.S. Appl. No. 12/853,255.
USPTO; Final Office Action dated Jul. 24, 2012 in U.S. Appl. No. 12/853,255.
USPTO; Office Action dated Jan. 18, 2013 in U.S. Appl. No. 12/853,255.
USPTO; Notice of Allowance dated Jun. 20, 2013 in U.S. Appl. No. 12/853,255.
USPTO; Office Action dated Apr. 19, 2012 in U.S. Appl. No. 12/853,268.
USPTO; Final Office Action dated Sep. 17, 2012 in U.S. Appl. No. 12/853,268.
USPTO; Notice of Allowance dated Nov. 21, 2012 in U.S. Appl. No. 12/853,268.
USPTO; Office Action dated Aug. 1, 2013 in U.S. Appl. No. 12/877,988.
USPTO; Notice of Allowance dated Dec. 24, 2013 in U.S. Appl. No. 12/877,988.
USPTO; Office Action dated May 29, 2012 in U.S. Appl. No. 12/878,984.
USPTO; Office Action dated Oct. 3, 2012 in U.S. Appl. No. 12/878,984.
USPTO; Final Office Action dated Jan. 25, 2013 in U.S. Appl. No. 12/878,984.
USPTO; Notice of Allowance dated Mar. 28, 2013 in U.S. Appl. No. 12/878,984.
USPTO; Office Action dated Sep. 22, 2011 in U.S. Appl. No. 12/880,027.
USPTO; Final Office Action dated Feb. 16, 2012 in U.S. Appl. No. 12/880,027.
USPTO; Office Action dated Dec. 14, 2012 in U.S. Appl. No. 12/880,027.
USPTO; Final Office Action dated Jul. 11, 2013 in U.S. Appl. No. 12/880,027.
USPTO; Office Action dated Jul. 16, 2014 in U.S. Appl. No. 12/880,027.
USPTO; Ex Parte Quayle Office Action dated Dec. 19, 2014 in U.S. Appl. No. 12/880,027.
USPTO; Notice of Allowance dated Apr. 8, 2015 in U.S. Appl. No. 12/880,027.
USPTO; Office Action dated Dec. 18, 2013 in U.S. Appl. No. 12/895,796.
USPTO; Final Office Action dated Jun. 3, 2014 in U.S. Appl. No. 12/895,796.
USPTO; Office Action dated Nov. 17, 2014 in U.S. Appl. No. 12/895,796.
USPTO; Office Action dated Sep. 1, 2015 in U.S. Appl. No. 12/895,796.
USPTO; Office Action dated Aug. 25, 2011 in U.S. Appl. No. 13/047,719.
USPTO; Final Office Action dated Dec. 16, 2011 in U.S. Appl. No. 13/047,719.

(56) References Cited

OTHER PUBLICATIONS

USPTO; Office Action dated Sep. 11, 2012 in U.S. Appl. No. 13/047,719.
USPTO; Notice of Allowance dated Feb. 28, 2013 in U.S. Appl. No. 13/047,719.
USPTO; Office Action dated Aug. 25, 2011 in U.S. Appl. No. 13/047,747.
USPTO; Final Office Action dated Feb. 7, 2012 in U.S. Appl. No. 13/047,747.
USPTO; Notice of Allowance dated Apr. 18, 2012 in U.S. Appl. No. 13/047,747.
USPTO; Office Action dated Dec. 13, 2012 in U.S. Appl. No. 13/047,747.
USPTO; Notice of Allowance dated Apr. 3, 2013 in U.S. Appl. No. 13/047,747.
USPTO; Office Action dated Apr. 12, 2013 in U.S. Appl. No. 13/106,853.
USPTO; Notice of Allowance dated Aug. 23, 2013 in U.S. Appl. No. 13/106,853.
USPTO; Office Action dated Apr. 18, 2012 in U.S. Appl. No. 13/252,145.
USPTO; Final Office Action dated Sep. 17, 2012 in U.S. Appl. No. 13/252,145.
USPTO; Notice of Allowance dated Nov. 30, 2012 in U.S. Appl. No. 13/252,145.
USPTO; Office Action dated Sep. 18, 2013 in U.S. Appl. No. 13/752,312.
USPTO; Final Office Action dated Jan. 27, 2014 in U.S. Appl. No. 13/752,312.
USPTO; Final Office Action dated May 23, 2014 in U.S. Appl. No. 13/752,312.
USPTO; Notice of Allowance dated Dec. 17, 2014 in U.S. Appl. No. 13/752,312.
USPTO; Office Action dated Sep. 6, 2013 in U.S. Appl. No. 13/725,383.
USPTO; Office Action dated Oct. 24, 2013 in U.S. Appl. No. 13/725,383.
USPTO; Office Action dated Mar. 3, 2015 in U.S. Appl. No. 13/725,383.
USPTO; Office Action dated Nov. 20, 2015 in U.S. Appl. No. 13/725,383.
USPTO; Office Action dated Sep. 11, 2013 in U.S. Appl. No. 13/756,468.
USPTO; Notice of Allowance dated Feb. 3, 2014 in U.S. Appl. No. 13/756,468.
USPTO; Office Action dated Sep. 10, 2014 in U.S. Appl. No. 13/791,952.
USPTO; Office Action dated Dec. 15, 2015 in U.S. Appl. No. 13/800,460.
USPTO; Office Action dated Sep. 23, 2014 in U.S. Appl. No. 13/843,947.
USPTO; Office Action dated Nov. 28, 2014 in U.S. Appl. No. 13/843,947.
USPTO; Final Office dated Apr. 10, 2015 in U.S. Appl. No. 13/843,947.
USPTO; Final Office Action dated Sep. 11, 2015 in 13/843,947.
USPTO; Ex Parte Quayle Action dated Jan. 25, 2016 in U.S. Appl. No. 13/843,947.
USPTO; Office Action dated Sep. 22, 2014 in U.S. Appl. No. 13/830,031.
USPTO; Notice of Allowance dated Jan. 30, 2015 in U.S. Appl. No. 13/830,031.
USPTO; Office Action dated Sep. 25, 2014 in U.S. Appl. No. 13/838,601.
USPTO; Final Office Action dated Mar. 3, 2015 in U.S. Appl. No. 13/838,601.
USPTO; Office Action dated Jul. 24, 2015 in U.S. Appl. No. 13/838,601.
USPTO; Office Action dated Aug. 14, 2014 in U.S. Appl. No. 13/791,889.
USPTO; Final Office Action dated Dec. 5, 2014 in U.S. Appl. No. 13/791,889.
USPTO; Office Action dated Sep. 15, 2014 in U.S. Appl. No. 13/797,616.
USPTO; Notice of Allowance dated Feb. 4, 2015 in U.S. Appl. No. 13/797,616.
USPTO; Restriction Requirement dated Sep. 17, 2014 in U.S. Appl. No. 13/801,907.
USPTO; Office Action dated Dec. 9, 2014 in U.S. Appl. No. 13/801,907.
USPTO; Notice of Allowance dated Jun. 5, 2015 in U.S. Appl. No. 13/801,907.
USPTO; Supplemental Notice of Allowance dated Oct. 2, 2015 in U.S. Appl. No. 13/801,907.
USPTO; Office Action dated Jan. 9, 2015 in U.S. Appl. No. 13/802,040.
USPTO; Notice of Allowance dated Jul. 14, 2015 in U.S. Appl. No. 13/802,040.
USPTO; Restriction Requirement dated Sep. 17, 2014 in U.S. Appl. No. 13/802,203.
USPTO; Office Action dated Dec. 11, 2014 in U.S. Appl. No. 13/802,203.
USPTO; Office Action dated Jan. 12, 2016 in U.S. Appl. No. 13/802,203.
USPTO; Office Action dated Feb. 13, 2015 in U.S. Appl. No. 13/973,962.
USPTO; Final Office Action dated Jul. 16, 2015 in U.S. Appl. No. 13/973,962.
USPTO; Office Action dated Apr. 10, 2015 in U.S. Appl. No. 14/027,237.
USPTO; Notice of Allowance dated Jan. 15, 2016 in U.S. Appl. No. 14/027,237.
USPTO; Notice of Allowance dated Nov. 24, 2015 in U.S. Appl. No. 13/973,962.
USPTO; Final Office Action dated Aug. 20, 2015 in U.S. Appl. No. 14/027,237.
USPTO; Ex Parte Quayle Action dated Nov. 4, 2015 in U.S. Appl. No. 14/027,237.
USPTO; Restriction Requirement dated Jun. 25, 2015 in U.S. Appl. No. 13/841,938.
USPTO; Office Action dated Aug. 25, 2015 in U.S. Appl. No. 13/841,938.
USPTO; Final Office Action dated Jul. 10, 2015 in U.S. Appl. No. 12/853,238.
USPTO; Final Office Action dated Jul. 10, 2015 in U.S. Appl. No. 13/725,383.
USPTO; Office Action dated Jul. 30, 2015 in U.S. Appl. No. 13/841,594.
USPTO; Final Office Action dated Feb. 23, 2016 in U.S. Appl. No. 13/841,594.
USPTO; Office Action dated Dec. 17, 2015 in U.S. Appl. No. 14/286,442.
USPTO; Office Action dated Dec. 23, 2015 in U.S. Appl. No. 14/662,100.
USPTO; Office Action dated Dec. 14, 2015 in U.S. Appl. No. 14/687,806.
USPTO; Office Action dated Dec. 18, 2015 in U.S. Appl. No. 14/689,879.
USPTO; Office Action dated Dec. 15, 2015 in U.S. Appl. No. 14/690,064.
USPTO; Office Action dated Dec. 31, 2015 in U.S. Appl. No. 14/690,099.
USPTO; Office Action dated Jan. 4, 2016 in U.S. Appl. No. 14/712,435.
USPTO; Office Action dated Feb. 11, 2016 in U.S. Appl. No. 14/690,174.
USPTO; Office Action dated Feb. 25, 2016 in U.S. Appl. No. 13/841,938.
USPTO; Notice of Allowance dated Mar. 8, 2016 in U.S. Appl. No. 13/973,962.
USPTO; Office Action dated Mar. 10, 2016 in U.S. Appl. No. 14/690,218.

(56) References Cited

OTHER PUBLICATIONS

USPTO; Notice of Allowance dated Mar. 11, 2016 in U.S. Appl. No. 13/843,947.
USPTO; Notice of Allowance dated Apr. 11, 2016 in U.S. Appl. No. 14/690,064.
USPTO; Notice of Allowance dated Apr. 12, 2016 in U.S. Appl. No. 14/027,237.
USPTO; Final Office Action dated May 2, 2016 in U.S. Appl. No. 14/687,806.
USPTO; Office action dated May 4, 2016 in U.S. Appl. No. 14/923,296.
USPTO; Notice of Allowance dated May 6, 2016 in U.S. Appl. No. 13/725,383.
USPTO; Notice of Allowance dated May 8, 2016 in U.S. Appl. No. 13/802,203.
USPTO; Office Action dated May 9, 2016 in U.S. Appl. No. 14/804,157.
USPTO; Office Action dated May 19, 2016 in U.S. Appl. No. 14/745,845.
USPTO; Office Action dated May 27, 2016 in U.S. Appl. No. 14/918,471.
USPTO; Office Action dated Jun. 6, 2016 in U.S. Appl. No. 14/808,935.
USPTO; Final Office Action dated Jun. 15, 2016 in U.S. Appl. No. 14/689,879.
USPTO; Notice of Allowance dated Jul. 7, 2016 in U.S. Appl. No. 14/804,157.
USPTO; Notice of Allowance dated Jul. 7, 2016 in U.S. Appl. No. 14/690,218.
USPTO; Notice of Allowance dated Jul. 7, 2016 in U.S. Appl. No. 14/690,099.
USPTO; Notice of Allowance dated Jul. 7, 2016 in U.S. Appl. No. 14/662,100.
USPTO; Notice of Allowance dated Jul. 20, 2016 in U.S. Appl. No. 14/715,435.
USPTO; Final Office Action dated Jul. 28, 2016 in U.S. Appl. No. 13/800,460.
USPTO; Office Action dated Aug. 1, 2016 in U.S. Appl. No. 15/153,735.
USPTO; Final Office Action dated Aug. 10, 2016 in U.S. Appl. No. 12/853,238.
USPTO; Office Action dated Aug. 15, 2016 in U.S. Appl. No. 14/811,655.
USPTO; Office Action dated Aug. 17, 2016 in U.S. Appl. No. 14/959,758.
USPTO; Final Office Action dated Aug. 26, 2016 in U.S. Appl. No. 14/923,296.
USPTO; Office action dated Aug. 29, 2016 in U.S. Appl. No. 14/687,806.
USPTO; Final Office Action dated Sep. 15, 2016 in U.S. Appl. No. 14/745,845.
USPTO; Office Action dated Sep. 15, 2016 in U.S. Appl. No. 14/746,593.
USPTO; Office Action dated Sep. 22, 2016 in U.S. Appl. No. 13/841,594.
USPTO; Notice of Allowance dated Sep. 28, 2016 in U.S. Appl. No. 14/918,471.
USPTO; Office Action dated Oct. 11, 2016 in U.S. Appl. No. 13/841,938.
USPTO; Office Action dated Oct. 27, 2016 in U.S. Appl. No. 14/689,879.
USPTO; Notice of Allowance dated Nov. 25, 2016 in U.S. Appl. No. 15/153,735.
USPTO; Notice of Allowance dated Nov. 29, 2016 in U.S. Appl. No. 14/808,935.
USPTO; Notice of Allowance dated Dec. 27, 2016 in U.S. Appl. No. 14/687,806.
USPTO; Notice of Allowance dated Dec. 30, 2016 in U.S. Appl. No. 14/923,296.
USPTO; Notice of Allowance dated Mar. 13, 2017 in U.S. Appl. No. 14/923,296.
USPTO; Final Office Action dated Mar. 17, 2017 in U.S. Appl. No. 14/811,655.
USPTO; Office Action dated Mar. 17, 2017 in U.S. Appl. No. 14/880,998.
USPTO; Final Office Action dated Mar. 29, 2017 in U.S. Appl. No. 14/959,758.
USPTO; Final Office Action dated Apr. 3, 2017 in U.S. Appl. No. 14/745,845.
USPTO; Office Action dated Apr. 11, 2017 in U.S. Appl. No. 14/959,811.
USPTO; Office Action dated Apr. 12, 2017 in U.S. Appl. No. 14/746,593.
USPTO; Office Action dated Apr. 20, 2017 in U.S. Appl. No. 14/959,653.
USPTO; Final Office Action dated May 10, 2017 in U.S. Appl. No. 14/689,879.
USPTO; Final Office Action dated Jun. 15, 2017 in U.S. Appl. No. 13/841,938.
USPTO; Office Action dated Aug. 1, 2017 in U.S. Appl. No. 14/811,655.
USPTO; Office Action dated Aug. 18, 2017 in U.S. Appl. No. 14/745,845.
USPTO; Office Action dated Aug. 22, 2017 in U.S. Appl. No. 15/194,544.
USPTO; Notice of Allowance dated Aug. 31, 2017 in U.S. Appl. No. 14/959,653.
USPTO; Office Action dated Sep. 1, 2017 in U.S. Appl. No. 14/689,879.
USPTO; Notice of Allowance dated Sep. 26, 2017 in U.S. Appl. No. 14/811,655.
USPTO; Final Office Action dated Sep. 26, 2017 in U.S. Appl. No. 14/959,811.
USPTO; Notice of Allowance dated Sep. 29, 2017 in U.S. Appl. No. 15/194,544.
USPTO; Non-Final Office Action dated Oct. 4, 2017 in U.S. Appl. No. 12/853,238.
USPTO; Non-Final Office Action dated Oct. 13, 2017 in U.S. Appl. No. 15/205,700.
USPTO; Non-Final Office Action dated Oct. 18, 2017 in U.S. Appl. No. 15/205,878.
USPTO; Notice of Allowance dated Oct. 20, 2017 in U.S. Appl. No. 13/800,460.
USPTO; Non-Final Office Action dated Nov. 1, 2017 in U.S. Appl. No. 15/209,660.
USPTO; Notice of Allowance dated Nov. 13, 2017 in U.S. Appl. No. 14/959,811.
USPTO; Non-Final Office Action dated Nov. 14, 2017 in U.S. Appl. No. 15/233,882.
USPTO; Notice of Allowance dated Nov. 16, 2017 in U.S. Appl. No. 15/194,544.
USPTO; Non-Final Office Action dated Nov. 16, 2017 in U.S. Appl. No. 15/233,946.
USPTO; Notice of Allowance dated Nov. 17, 2017 in U.S. Appl. No. 13/800,460.
USPTO; Non-Final Office Action dated Nov. 17, 2017 in U.S. Appl. No. 13/841,938.
USPTO; Non-Final Office Action dated Nov. 20, 2017 in U.S. Appl. No. 14/791,166.
USPTO; Non-Final Office Action dated Dec. 4, 2017 in U.S. Appl. No. 15/234,490.
USPTO; Non-Final Office Action dated Dec. 6, 2017 in U.S. Appl. No. 14/791,137.
USPTO; Notice of Allowance dated Dec. 6, 2017 in U.S. Appl. No. 14/959,653.
USPTO; Notice of Allowance dated Dec. 8, 2017 in U.S. Appl. No. 14/811,655.
USPTO; Notice of Allowance dated Dec. 12, 2017 in U.S. Appl. No. 14/959,811.
USPTO; Notice of Allowance dated Dec. 20, 2017 in U.S. Appl. No. 13/800,460.

(56) References Cited

OTHER PUBLICATIONS

USPTO; Non-Final Office Action dated Jan. 5, 2018 in U.S. Appl. No. 15/013,879.
USPTO; Notice of Allowance dated Jan. 5, 2018 in U.S. Appl. No. 15/194,544.
USPTO; Final Office Action dated Jan. 10, 2018 in U.S. Appl. No. 14/689,879.
USPTO; Final Office Action dated Jan. 17, 2018 in U.S. Appl. No. 14/745,845.
USPTO; Notice of Allowance dated Jan. 22, 2018 in U.S. Appl. No. 13/800,460.
USTPO; Notice of Allowance dated Feb. 8, 2018 in U.S. Appl. No. 15/194,544.
USPTO; Notice of Allowance dated Feb. 14, 2018 in U.S. Appl. No. 14/959,811.
USPTO; Notice of Allowance dated Mar. 12, 2018 in U.S. Appl. No. 15/209,660.
USPTO; Final Office Action dated Mar. 20, 2018 in U.S. Appl. No. 15/205,700.
USPTO; Final Office Action dated Apr. 25, 2018 in U.S. Appl. No. 15/233,946.
USPTO; Final Office Action dated Apr. 26, 2018 in U.S. Appl. No. 15/233,882.
USPTO; Notice of Allowance dated May 11, 2018 in U.S. Appl. No. 14/689,879.
USPTO; Final Office Action dated May 17, 2018 in U.S. Appl. No. 15/234,490.
USPTO; Non-Final Office Action dated May 18, 2018 in U.S. Appl. No. 14/745,845.
USPTO; Notice of Allowance dated May 22, 2018 in U.S. Appl. No. 15/435,884.
USPTO; Non-Final Office Action dated May 24, 2018 in U.S. Appl. No. 15/332,163.
USPTO; Non-Final Office Action dated May 30, 2018 in U.S. Appl. No. 15/371,086.
USPTO; Final Office Action dated Jun. 4, 2018 in U.S. Appl. No. 14/791,137.
USPTO; Notice of Allowance dated Jun. 5, 2018 in U.S. Appl. No. 13/841,938.
USPTO; Notice of Allowance dated Jun. 15, 2018 in U.S. Appl. No. 13/841,938.
USPTO; Non-Final Office Action dated Jun. 21, 2018 in U.S. Appl. No. 12/853,238.
USPTO; Notice of Allowance dated Jun. 22, 2018 in U.S. Appl. No. 13/841,938.
USPTO, Non-Final Office Action dated Jun. 28, 2018 in U.S. Appl. No. 14/791,166.
USPTO; Non-Final Office Action dated Jun. 28, 2018 in U.S. Appl. No. 15/431,596.
USPTO; Non-Final Office Action dated Jul. 2, 2108 in U.S. Appl. No. 15/619,289.
USPTO; Non-Final Office Action dated Jul. 6, 2018 in U.S. Appl. No. 15/902,444.
USPTO; Non-Final Office Action dated Jul. 11, 2018 in U.S. Appl. No. 15/339,624.
USPTO; Final Office Action dated Jul. 11, 2018 in U.S. Appl. No. 15/013,879.
USPTO; Notice of Allowance dated Jul. 25, 2018 in U.S. Appl. No. 14/689,879.
USPTO; Notice of Allowance dated Jul. 30, 2018 in U.S. Appl. No. 15/205,700.
USPTO; Notice of Allowance dated Aug. 6, 2018 in U.S. Appl. No. 15/233,882.
USPTO; Notice of Allowance dated Aug. 13, 2018 in U.S. Appl. No. 15/233,882.
USPTO; Notice of Allowance dated Aug. 13, 2018 in U.S. Appl. No. 15/233,946.
USPTO; Non-Final Office Action dated Aug. 31, 2018 in U.S. Appl. No. 15/234,490.
USPTO; Non-Final Office Action dated Sep. 11, 2018 in U.S. Appl. No. 15/406,515.
USPTO; Non-Final Office Action dated Sep. 20, 2018 in U.S. Appl. No. 15/804,903.
USPTO; Notice of Allowance dated Sep. 25, 2018 in U.S. Appl. No. 14/791,166.
USPTO; Non-Final Office Action dated Oct. 5, 2018 in U.S. Appl. No. 16/030,547.
USPTO; Notice of Allowance dated Oct. 12, 2018 in U.S. Appl. No. 14/791,166.
USPTO; Non-Final Office Action dated Oct. 25, 2018 in U.S. Appl. No. 14/791,137.
USPTO; Ex Parte Quayle Action dated Nov. 7, 2018 in U.S. Appl. No. 15/332,163.
USPTO; Non-Final Office Action date Nov. 7, 2018 in U.S. Appl. No. 15/205,700.
USPTO; Notice of Allowance dated Nov. 9, 2018 in U.S. Appl. No. 15/431,596.
USPTO; Final Office Action dated Nov. 30, 2018 in U.S. Appl. No. 14/745,845.
USPTO; Final Office Action dated Nov. 30, 2018 in U.S. Appl. No. 15/371,086.
USPTO; Final Office Action dated Dec. 4, 2018 in U.S. Appl. No. 15/619,289.
USPTO; Notice of Allowance dated Dec. 13, 2018 in U.S. Appl. No. 15/406,515.
USPTO; Notice of Allowance dated Jan. 3, 2019 in U.S. Appl. No. 15/341,596.
USPTO; Notice of Allowance dated Jan. 8, 2019 in U.S. Appl. No. 15/339,624.
USPTO; Notice of Allowance dated Jan. 18, 2019 in U.S. Appl. No. 15/234,490.
USPTO; Non-Final Office Action dated Jan. 23, 2019 in U.S. Appl. No. 16/144,873.
USPTO; Notice of Allowance dated Jan. 28, 2019 in U.S. Appl. No. 16/030,547.
USPTO; Notice of Allowance dated Feb. 12, 2019 in U.S. Appl. No. 15/332,163.
USPTO; Notice of Allowance dated Feb. 21, 2019 in U.S. Appl. No. 15/902,444.
USPTO; Final Office Action dated Feb. 25, 2019 in U.S. Appl. No. 12/853,238.
USPTO; Non-Final Office Action dated Feb. 27, 2019 in U.S. Appl. No. 15/013,879.
USPTO; Notice of Allowance dated Mar. 4, 2019 in U.S. Appl. No. 15/205,700.
USPTO; Notice of Allowance dated Mar. 13, 2019 in U.S. Appl. No. 14/745,845.
USPTO; Notice of Allowance dated Mar. 13, 2019 in U.S. Appl. No. 15/902,444.
USPTO; Notice of Allowance dated Mar. 15, 2019 in U.S. Appl. No. 16/030,547.
USPTO; Final Office Action dated Mar. 18, 2019 in U.S. Appl. No. 14/791,137.
USPTO; Notice of Allowance dated Mar. 18, 2019 in U.S. Appl. No. 15/205,700.
USPTO; Notice of Allowance dated Mar. 19, 2019 in U.S. Appl. No. 15/332,163.
USPTO; Notice of Allowance dated Mar. 20, 2019 in U.S. Appl. No. 15/234,490.
USPTO; Notice of Allowance dated Mar. 21, 2019 in U.S. Appl. No. 12/853,238.
USPTO; Notice of Allowance dated Apr. 5, 2019 in U.S. Appl. No. 15/902,444.
USPTO; Notice of Allowance dated Apr. 23, 2019 in U.S. Appl. No. 15/234,490.
USPTO; Notice of Allowance dated Apr. 18, 2019 in U.S. Appl. No. 15/205,700.
USPTO; Notice of Allowance dated Apr. 19, 2019 in U.S. Appl. No. 15/332,163.
USPTO; Office Action dated Jun. 12, 2019 in U.S. Appl. No. 15/371,086.

(56) References Cited

OTHER PUBLICATIONS

USPTO; Office Action dated Jun. 13, 2019 in U.S. Appl. No. 15/804,903.
USPTO; Office Action dated Jun. 27, 2019 in U.S. Appl. No. 15/849,479.
USPTO; Office Action dated Aug. 2, 2019 in U.S. Appl. No. 16/415,271.
USPTO; Final Office Action dated Sep. 11, 2019 in U.S. Appl. No. 16/144,873.
USPTO; Ex Parte Quayle Action dated Jun. 5, 2019 in U.S. Appl. No. 15/619,289.
USPTO; Notice of Allowance dated Aug. 14, 2019 in U.S. Appl. No. 15/619,289.
USPTO; Notice of Allowance dated Jul. 25, 2019 in U.S. Appl. No. 14/791,137.
USPTO; Final Office Action dated Aug. 6, 2019 in U.S. Appl. No. 15/013,879.
USPTO; Notice of Allowance dated Oct. 24, 2019 in U.S. Appl. No. 15/849,479.
USPTO; Notice of Allowance dated Nov. 14, 2019 in U.S. Appl. No. 15/371,086.
USPTO; Notice of Allowance dated Dec. 30, 2019 in U.S. Appl. No. 16/144,873.
USPTO; Non-Final Office Action dated Jan. 8, 2020 in the U.S. Appl. No. 15/013,879.
USPTO; Notice of Allowance dated Feb. 10, 2020 in the U.S. Appl. No. 16/415,271.
USPTO; Notice of Allowance dated Mar. 3, 2020 in the U.S. Appl. No. 15/804,903.
USPTO; Non-Final Office Action dated May 4, 2020 in the U.S. Appl. No. 15/916,089.
USPTO; Final Office Action dated May 11, 2020 in the U.S. Appl. No. 15/013,879.
USPTO; Restriction Requirement dated Oct. 1, 2020 in the U.S. Appl. No. 16/195,678.
USPTO; Final Office Action dated Oct. 8, 2020 in the U.S. Appl. No. 15/916,089.
USPTO; Notice of Allowance dated Nov. 18, 2020 in the U.S. Appl. No. 15/013,879.
USPTO; Non-Final Office Action dated Oct. 13, 2020 in the U.S. Appl. No. 16/862,333.
CIPO; Office Action dated Dec. 4, 2001 in Application No. 2,115,929.
CIPO; Office Action dated Apr. 22, 2002 in Application No. 2,115,929.
CIPO; Notice of Allowance dated Jul. 18, 2003 in Application No. 2,115,929.
CIPO; Office Action dated Jun. 30, 2003 in Application No. 2,176,475.
CIPO; Notice of Allowance dated Sep. 15, 2004 in Application No. 2,176,475.
CIPO; Office Action dated May 29, 2000 in Application No. 2,242,174.
CIPO; Office Action dated Feb. 22, 2006 in Application No. 2,244,251.
CIPO; Office Action dated Mar. 27, 2007 in Application No. 2,244,251.
CIPO; Notice of Allowance dated Jan. 15, 2008 in Application No. 2,244,251.
CIPO; Office Action dated Sep. 18, 2002 in Application No. 2,305,865.
CIPO; Notice of Allowance dated May 2, 2003 in Application No. 2,305,865.
EPO; Examination Report dated Oct. 6, 2008 in Application No. 08158682.
EPO; Office Action dated Jan. 26, 2010 in Application No. 08158682.
EPO; Office Action dated Feb. 15, 2011 in Application No. 08158682.
EPO; Search Report dated Nov. 9, 1998 in Application No. 98112356.
EPO; Office Action dated Feb. 6, 2003 in Application No. 99941032.
EPO; Office Action dated Aug. 20, 2004 in Application No. 99941032.
PCT; International Search Report or Declaration dated Nov. 15, 1999 in Application No. PCT/US1999/18178.
PCT; International Search Report or Declaration dated Oct. 9, 1998 in Application No. PCT/US1999/22440.
USPTO; Non-Final Office Action dated Apr. 14, 2021 in the U.S. Appl. No. 16/533,383.
USPTO; Non-Final Office Action dated Apr. 13, 2021 in the U.S. Appl. No. 16/533,404.
USPTO; Non-Final Office Action dated Feb. 25, 2021 in the U.S. Appl. No. 15/916,089.
UPTO; Non-Final Office Action dated Apr. 15, 2021 in the U.S. Appl. No. 16/413,142.
USPTO; Non-Final Office Action dated Feb. 23, 2021 in the U.S. Appl. No. 16/728,966.
USPTO; Non-Final Office Action dated Mar. 22, 2021 in the U.S. Appl. No. 16/728,978.
USPTO; Notice of Allowance dated Apr. 19, 2021 in the U.S. Appl. No. 16/728,978.
USPTO; Non-Final Office Action dated Mar. 25, 2021 in the U.S. Appl. No. 16/729,009.
USPTO; Non-Final Office Action dated Apr. 2, 2021 in the U.S. Appl. No. 16/729,033.
USPTO; Non-Final OA dated Mar. 25, 2021 in the U.S. Appl. No. 16/790,734.
USPTO; Non-Final OA dated Mar. 31, 2021 in the U.S. Appl. No. 16/792,643.
USPTO; Notice of Allowance dated Apr. 28, 2021 in the U.S. Appl. No. 16/792,643.
USPTO; Notice of Allowance dated Jun. 2, 2021 in the U.S. Appl. No. 16/728,966.
USPTO; Non-Final Office Action dated Jun. 7, 2021 in the U.S. Appl. No. 16/195,678.
USPTO; Final Office Action dated Jun. 10, 2021 in the U.S. Appl. No. 16/862,333.
USPTO; Final Office Action dated Jun. 11, 2021 in the U.S. Appl. No. 15/916,089.

* cited by examiner

SECTION A-A

SECTION B-B

SECTION A-A

TRANSFER STRUCTURE WITH MOLTEN METAL PUMP SUPPORT

CROSS-REFERENCE TO RELATED APPLICATIONS

This application is a continuation of, and claims priority to U.S. patent application Ser. No. 15/849,479 (Now U.S. Pat. No. 10,562,097), filed on Dec. 20, 2017, which is a continuation of, and claims priority to U.S. patent application Ser. No. 14/811,655 (Now U.S. Pat. No. 9,855,600), filed on Jul. 28, 2015, which is a continuation of, and claims priority to U.S. patent application Ser. No. 13/802,040 (Now U.S. Pat. No. 9,156,087), filed on Mar. 13, 2013, by Paul V. Cooper, which is a continuation-in-part of, and claims priority to, U.S. patent application Ser. No. 13/725,383 (Now U.S. Pat. No. 9,383,140), filed on Dec. 21, 2012, by Paul V. Cooper, which is a divisional of, and claims priority to U.S. patent application Ser. No. 11/766,617 (Now U.S. Pat. No. 8,337,746), filed on Jun. 21, 2007, by Paul V. Cooper, each of the foregoing disclosures of which that are not inconsistent with the present disclosure are incorporated herein by reference. This application also incorporates by reference the portions of U.S. patent application Ser. No. 13/797,616 (Now U.S. Pat. No. 9,017,597), filed on Mar. 12, 2013, by Paul V. Cooper, that are not inconsistent with this disclosure.

FIELD OF THE INVENTION

The invention relates to a system for moving molten metal out of a vessel, and components used in such a system.

BACKGROUND OF THE INVENTION

As used herein, the term "molten metal" means any metal or combination of metals in liquid form, such as aluminum, copper, iron, zinc and alloys thereof. The term "gas" means any gas or combination of gases, including argon, nitrogen, chlorine, fluorine, freon, and helium, that are released into molten metal.

Known molten-metal pumps include a pump base (also called a housing or casing), one or more inlets (an inlet being an opening in the housing to allow molten metal to enter a pump chamber), a pump chamber, which is an open area formed within the housing, and a discharge, which is a channel or conduit of any structure or type communicating with the pump chamber (in an axial pump the chamber and discharge may be the same structure or different areas of the same structure) leading from the pump chamber to an outlet, which is an opening formed in the exterior of the housing through which molten metal exits the casing. An impeller, also called a rotor, is mounted in the pump chamber and is connected to a drive system. The drive system is typically an impeller shaft connected to one end of a drive shaft, the other end of the drive shaft being connected to a motor. Often, the impeller shaft is comprised of graphite, the motor shaft is comprised of steel, and the two are connected by a coupling. As the motor turns the drive shaft, the drive shaft turns the impeller and the impeller pushes molten metal out of the pump chamber, through the discharge, out of the outlet and into the molten metal bath. Most molten metal pumps are gravity fed, wherein gravity forces molten metal through the inlet and into the pump chamber as the impeller pushes molten metal out of the pump chamber.

A number of submersible pumps used to pump molten metal (referred to herein as molten metal pumps) are known in the art. For example, U.S. Pat. No. 2,948,524 to Sweeney et al., U.S. Pat. No. 4,169,584 to Mangalick, U.S. Pat. No. 5,203,681 to Cooper, U.S. Pat. No. 6,093,000 to Cooper and U.S. Pat. No. 6,123,523 to Cooper, and U.S. Pat. No. 6,303,074 to Cooper, all disclose molten metal pumps. The disclosures of the patents to Cooper noted above are incorporated herein by reference. The term submersible means that when the pump is in use, its base is at least partially submerged in a bath of molten metal.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of the charging well where scrap metal is charged (i.e., added).

Transfer pumps are generally used to transfer molten metal from the external well of a reverbatory furnace to a different location such as a ladle or another furnace.

Gas-release pumps, such as gas-injection pumps, circulate molten metal while introducing a gas into the molten metal. In the purification of molten metals, particularly aluminum, it is frequently desired to remove dissolved gases such as hydrogen, or dissolved metals, such as magnesium. As is known by those skilled in the art, the removing of dissolved gas is known as "degassing" while the removal of magnesium is known as "demagging." Gas-release pumps may be used for either of these purposes or for any other application for which it is desirable to introduce gas into molten metal.

Gas-release pumps generally include a gas-transfer conduit having a first end that is connected to a gas source and a second end submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where molten metal enters the pump chamber.

Generally, a degasser (also called a rotary degasser) includes (1) an impeller shaft having a first end, a second end and a passage for transferring gas, (2) an impeller, and (3) a drive source for rotating the impeller shaft and the impeller. The first end of the impeller shaft is connected to the drive source and to a gas source and the second end is connected to the connector of the impeller. Examples of rotary degassers are disclosed in U.S. Pat. No. 4,898,367 entitled "Dispersing Gas Into Molten Metal," U.S. Pat. No. 5,678,807 entitled "Rotary Degassers," and U.S. Pat. No. 6,689,310 to Cooper entitled "Molten Metal Degassing Device and Impellers Therefore," filed May 12, 2000, the respective disclosures of which are incorporated herein by reference.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Generally a scrap melter includes an impeller affixed to an end of a drive shaft, and a drive source attached to the other end of the drive shaft for rotating the shaft and the impeller. The movement of the impeller draws molten metal and scrap metal downward into the molten metal bath in order to melt the scrap. A circulation pump is preferably used in conjunction with the scrap melter to circulate the molten metal in order to maintain a relatively constant temperature within the molten metal. Scrap melters are disclosed in U.S. Pat. No. 4,598,899 to Cooper, U.S. patent application Ser. No. 09/649,190 to Cooper, filed Aug. 28, 2000, and U.S. Pat. No. 4,930,986 to Cooper, the respective disclosures of which are incorporated herein by reference.

Molten metal transfer pumps have been used, among other things, to transfer molten aluminum from a well to a ladle or launder, wherein the launder normally directs the molten aluminum into a ladle or into molds where it is cast into solid, usable pieces, such as ingots. The launder is essentially a trough, channel or conduit outside of the reverbatory furnace. A ladle is a large vessel into which molten metal is poured from the furnace. After molten metal is placed into the ladle, the ladle is transported from the furnace area to another part of the facility where the molten metal inside the ladle is poured into other vessels, such as smaller holders or molds. A ladle is typically filled in two ways. First, the ladle may be filled by utilizing a transfer pump positioned in the furnace to pump molten metal out of the furnace, through a metal-transfer conduit and over the furnace wall, into the ladle or other vessel or structure. Second, the ladle may be filled by transferring molten metal from a hole (called a tap-out hole) located at or near the bottom of the furnace and into the ladle. The tap-out hole is typically a tapered hole or opening, usually about 1"-4" in diameter that receives a tapered plug called a "tap-out plug." The plug is removed from the tap-out hole to allow molten metal to drain from the furnace, and is inserted into the tap-out hole to stop the flow of molten metal out of the furnace.

There are problems with each of these known methods. Referring to filling a ladle utilizing a transfer pump, there is splashing (or turbulence) of the molten metal exiting the transfer pump and entering the ladle. This turbulence causes the molten metal to interact more with the air than would a smooth flow of molten metal pouring into the ladle. The interaction with the air leads to the formation of dross within the ladle and splashing also creates a safety hazard because persons working near the ladle could be hit with molten metal. Further, there are problems inherent with the use of most transfer pumps. For example, the transfer pump can develop a blockage in the riser, which is an extension of the pump discharge that extends out of the molten metal bath in order to pump molten metal from one structure into another. The blockage blocks the flow of molten metal through the pump and essentially causes a failure of the system. When such a blockage occurs the transfer pump must be removed from the furnace and the riser tube must be removed from the transfer pump and replaced. This causes hours of expensive downtime. A transfer pump also has associated piping attached to the riser to direct molten metal from the vessel containing the transfer pump into another vessel or structure. The piping is typically made of steel with an internal liner. The piping can be between 1 and 50 feet in length or even longer. The molten metal in the piping can also solidify causing failure of the system and downtime associated with replacing the piping.

If a tap-out hole is used to drain molten metal from a furnace a depression may be formed in the factory floor or other surface on which the furnace rests, and the ladle can preferably be positioned in the depression so it is lower than the tap-out hole, or the furnace may be elevated above the floor so the tap-out hole is above the ladle. Either method can be used to enable molten metal to flow using gravity from the tap-out hole into the ladle.

Use of a tap-out hole at the bottom of a furnace can lead to problems. First, when the tap-out plug is removed molten metal can splash or splatter causing a safety problem. This is particularly true if the level of molten metal in the furnace is relatively high which leads to a relatively high pressure pushing molten metal out of the tap-out hole. There is also a safety problem when the tap-out plug is reinserted into the tap-out hole because molten metal can splatter or splash onto personnel during this process. Further, after the tap-out hole is plugged, it can still leak. The leak may ultimately cause a fire, lead to physical harm of a person and/or the loss of a large amount of molten metal from the furnace that must then be cleaned up, or the leak and subsequent solidifying of the molten metal may lead to loss of the entire furnace.

Another problem with tap-out holes is that the molten metal at the bottom of the furnace can harden if not properly circulated thereby blocking the tap-out hole or the tap-out hole can be blocked by a piece of dross in the molten metal.

A launder may be used to pass molten metal from the furnace and into a ladle and/or into molds, such as molds for making ingots of cast aluminum. Several die cast machines, robots, and/or human workers may draw molten metal from the launder through openings (sometimes called plug taps). The launder may be of any dimension or shape. For example, it may be one to four feet in length, or as long as 100 feet in length. The launder is usually sloped gently, for example, it may historically be sloped downward at a slope of approximately ⅛ inch per each ten feet in length, in order to use gravity to direct the flow of molten metal out of the launder, either towards or away from the furnace, to drain all or part of the molten metal from the launder once the pump supplying molten metal to the launder is shut off. In use, a typical launder includes molten aluminum at a depth of approximately 1-10."

Whether feeding a ladle, launder or other structure or device utilizing a transfer pump, the pump is turned off and on according to when more molten metal is needed. This can be done manually or automatically. If done automatically, the pump may turn on when the molten metal in the ladle or launder is below a certain amount, which can be measured in any manner, such as by the level of molten metal in the launder or level or weight of molten metal in a ladle. A switch activates the transfer pump, which then pumps molten metal from the pump well, up through the transfer pump riser, and into the ladle or launder. The pump is turned off when the molten metal reaches a given amount in a given structure, such as a ladle or launder. This system suffers from the problems previously described when using transfer pumps. Further, when a transfer pump is utilized it must generally operate at a high speed (RPM) in order to generate enough pressure to push molten metal upward through the riser and into the ladle or launder. Therefore, there can be lags wherein there is no or too little molten metal exiting the transfer pump riser and/or the ladle or launder could be over filled because of a lag between detection of the desired amount having been reached, the transfer pump being shut off, and the cessation of molten metal exiting the transfer pump.

Furthermore, there are passive systems wherein molten metal is transferred from a vessel to another by the flow into the vessel causing the level in the vessel to rise to the point at which it reaches an output port, which is any opening that permits molten metal to exit the vessel. The problem with such a system is that thousands of pounds of molten metal can remain in the vessel, and the tap-out plug must be removed to drain it. When molten metal is drained using a tap-out plug, the molten metal fills another vessel, such as a sow mold, on the factory floor. First, turbulence is created when the molten metal pours from the tap-out plug opening and into such a vessel. This can cause dross to form and negate any degassing that had previously been done. Second, the vessel into which the molten metal is drained must then be moved and manipulated to remove molten metal from it prior to the molten metal hardening.

Thus, known methods of transferring molten metal from one vessel to another can result in thousands of pounds of a molten aluminum alloy left in the vessel, which could then harden. Or, the molten metal must be removed by utilizing a tap-out plug as described above.

It is preferred that a system having a transfer chamber according to the invention is more positively controlled than either: (1) A passive system, wherein molten metal flows into one side of a vessel and, as the level increases inside of the vessel, the level reaches a point at which the molten metal flows out of an outlet on the opposite side. Such a vessel may be tilted or have an angled inner bottom surface to help cause molten metal to flow towards the side that has the outlet. (2) A system utilizing a molten-metal transfer pump, because of the inherent problems with transfer pumps, which are generally described in this Background section.

Furthermore, launders into which molten metal exiting a vessel might flow have been angled downwards from the outlet of the vessel so that gravity helps drain the molten metal out of the launder. This was often necessary because launders were typically used in conjunction with tap-out plugs at the bottom of a vessel, and tap-out plugs are dimensionally relatively small, plus they have the pressure of the molten metal in the vessel behind them. Thus, molten metal in a launder could not flow backward into a tap-out plug. The problem with such a launder is that when exposed to the air, molten metal oxidizes and forms dross, which in a launder appears as a semi-solid or solid skin on the surface of the molten metal. When the launder is angled downwards, the dross, or skin, is usually pulled into the molten metal flow and into whatever downstream vessel is being filled. This creates contamination in the finished product.

SUMMARY OF THE INVENTION

The invention relates to systems and methods for transferring molten metal from one structure to another. Aspects of the invention include a transfer chamber constructed inside of or next to a vessel used to retain molten metal. The transfer chamber is in fluid communication with the vessel so molten metal from the vessel can enter the transfer chamber. In certain embodiments, inside of the transfer chamber is a powered device that moves molten metal upward and out of the transfer chamber and preferably into a structure outside of the vessel, such as another vessel or a launder.

In one embodiment, the powered device is a type of molten metal pump designed to work in the transfer chamber. The pump includes a motor and a drive shaft connected to a rotor. The pump may or may not include a pump base or support posts. The rotor is designed to drive molten metal upwards through an enclosed section of the transfer chamber, and fits into the transfer chamber in such a manner as to utilize part of the transfer chamber structure as a pump chamber to create the necessary pressure to move molten metal upwards as the rotor rotates. As the system is utilized, it moves molten metal upward through the transfer structure where it exits through an outlet.

A key advantage of the present system is that the amount of molten metal entering the launder, and the level in the launder, can remain constant regardless of the amount of or level of molten metal entering the transfer chamber with prior art systems, the metal level in the transfer chamber rises and falls and can affect the molten metal level in the launder. Alternatively, the molten metal can be removed from the vessel utilizing a tap-out plug, which is associated with the problems previously described.

The system may be used in combination with a circulation or gas-release (also called a gas-injection) pump that moves molten metal in the vessel towards the transfer structure. Alternatively, a circulation or gas-release pump may be used with or without the pump in the transfer chamber, in which case the pump may be utilized with a wall that separates the vessel into two or more sections with the circulation pump in one of the sections, and the transfer chamber in another section. There would then be an opening in the wall in communication with the pump discharge. As the pump operates it would move molten metal through the opening in the wall and into the section of the vessel containing the transfer chamber. The molten metal level in that section would then rise until it exits an outlet in communication with the transfer chamber.

In an alternate embodiment, a molten metal pump is utilized that has a pump base and a riser tube that directs molten metal upward into the enclosed structure (or uptake section) of the transfer chamber, wherein the pressure generated by the pump pushes the molten metal upward through the riser tube, through the enclosed structure and out of an outlet in communication with the transfer chamber.

Also described herein is a transfer chamber and a rotor that can be used in the practice of the invention.

It has also been discovered that by making the launder either level (i.e., at a 0° incline) or inclined backwards towards the vessel so that molten metal in the launder drains back into the vessel, the dross or skin that forms on the surface of the molten metal in the launder is not pulled away with the molten metal entering downstream vessels. Thus, this dross is less likely to contaminate any finished product, which is a substantial benefit. Preferably, a launder according to the inventor is formed at a horizontal angle leaning back towards the vessel of 0° to 10°, or 0° to 5°, or 0° to 3°, or 1° to 3°, or at a slope of about ⅛" for every 10' of launder.

DETAILED DESCRIPTION OF PREFERRED EMBODIMENTS

Figure 1:
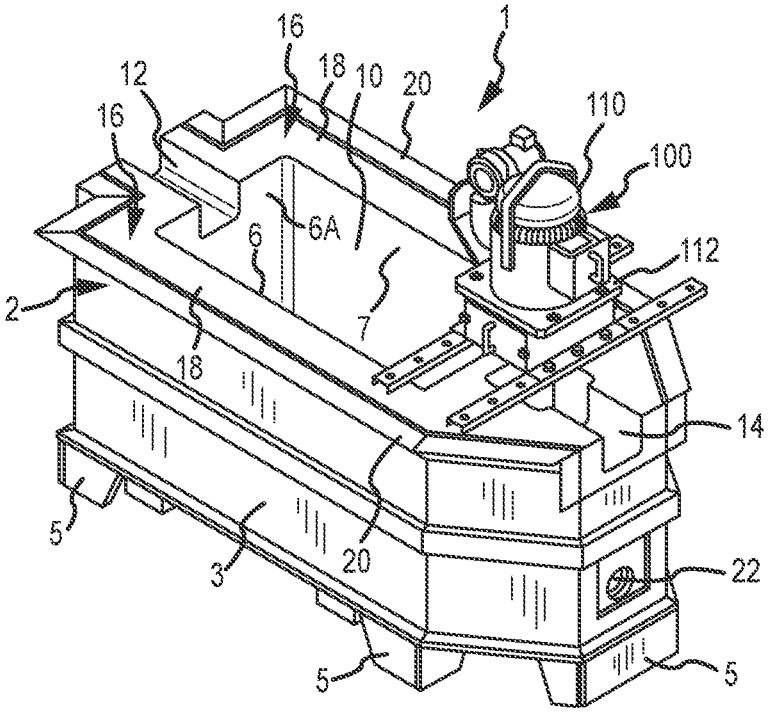
FIG. 1 is a top, perspective view of a system according to the invention, wherein a transfer chamber is included installed in a vessel designed to contain molten metal.
Figure 2:
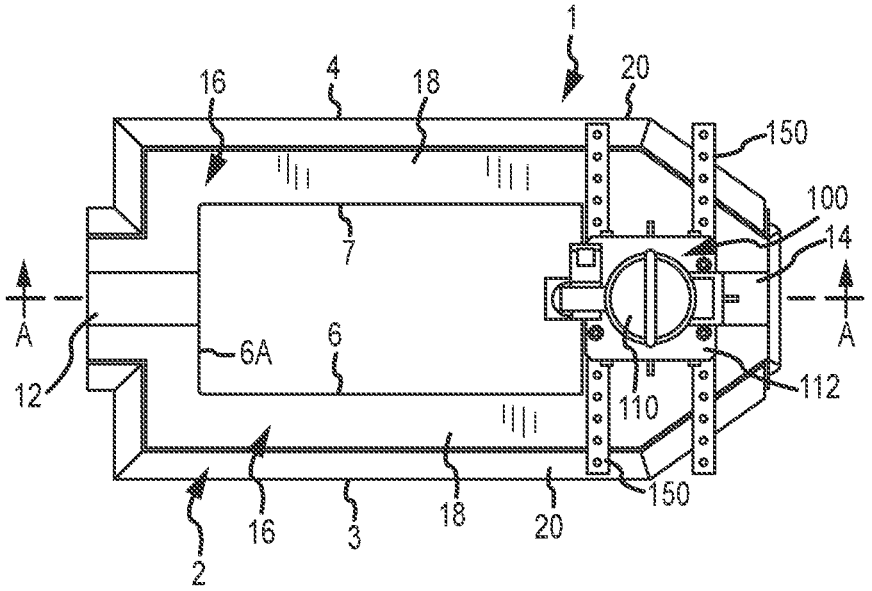
FIG. 2 is a top view of the system according to FIG. 1.
Figure 3:
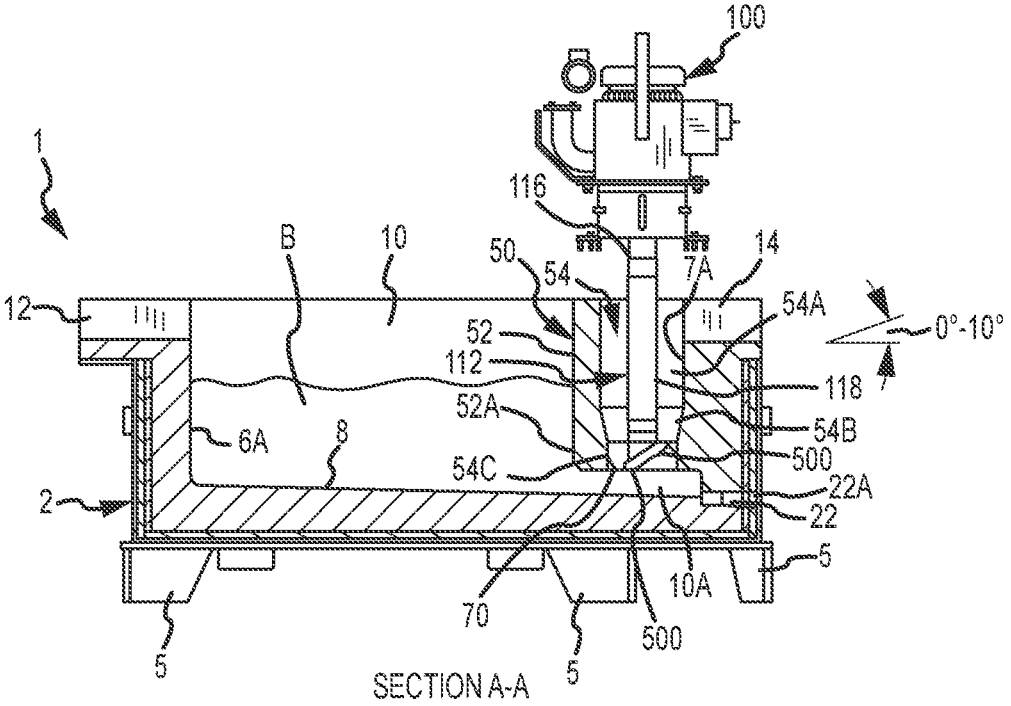
FIG. 3 is a side, partial cross-sectional view of the system of FIG. 1.
Figure 6:
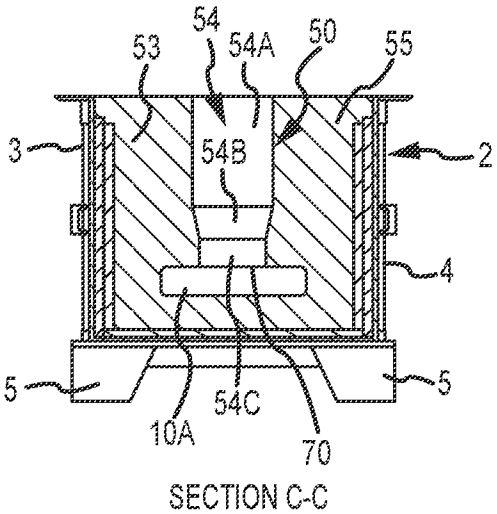
FIG. 6 is a cross-sectional view of the system of FIG. 4 taken along line C-C.
Figure 4:
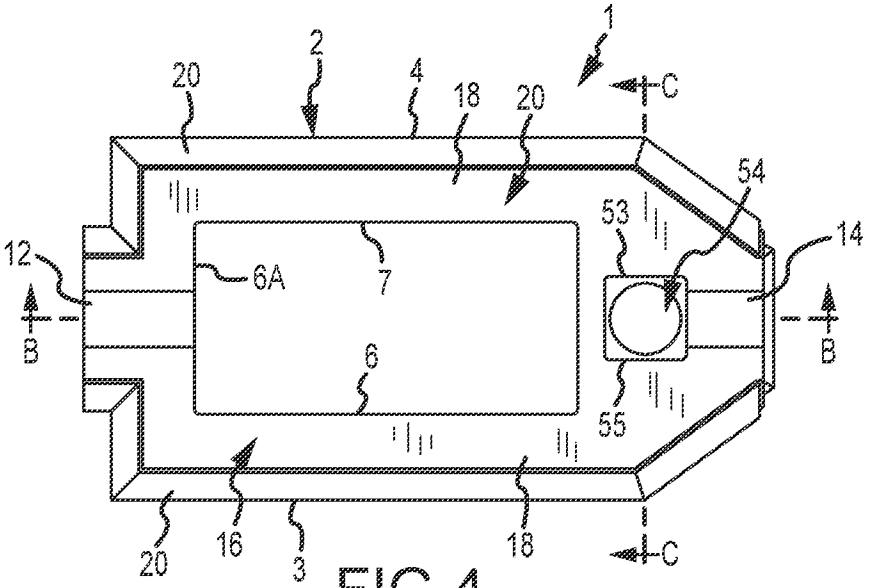
FIG. 4 is a top view of the system of FIG. 1 with the pump removed.
Figure 5:
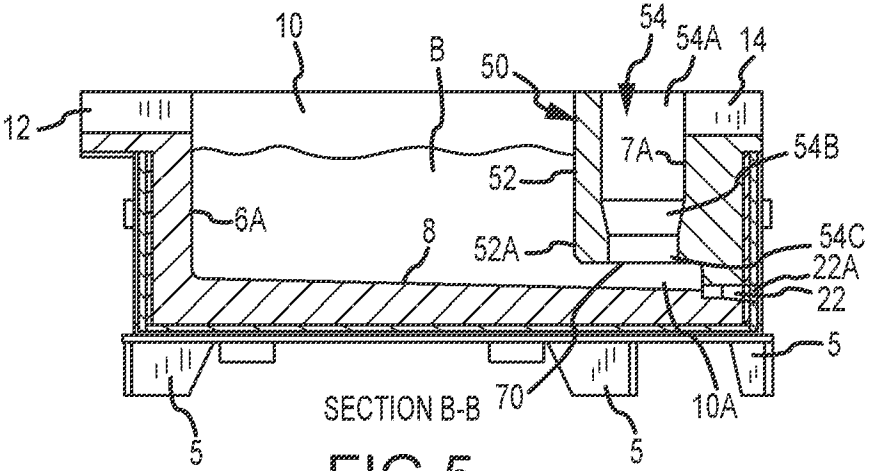
FIG. 5 is a side, partial cross-sectional view of the system of FIG. 4 taken along line B-B.
Figure 7:
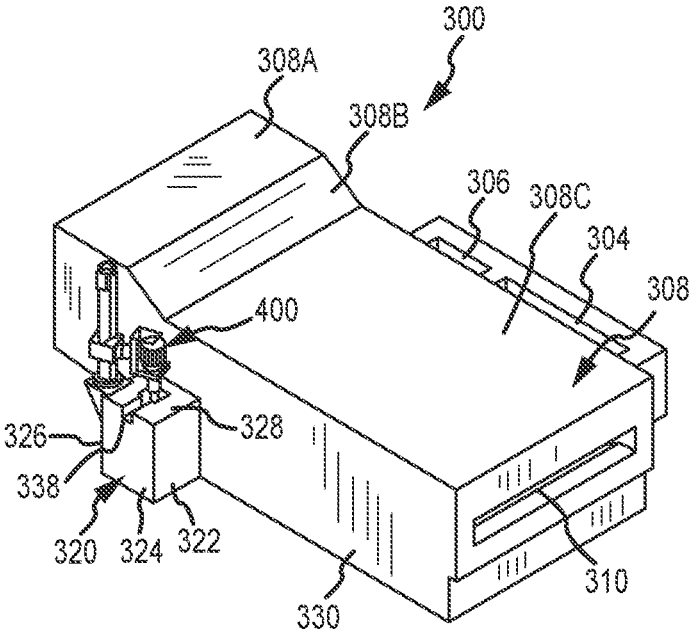
FIG. 7 is a top, perspective view of another system in accordance with the invention.
Figure 8:
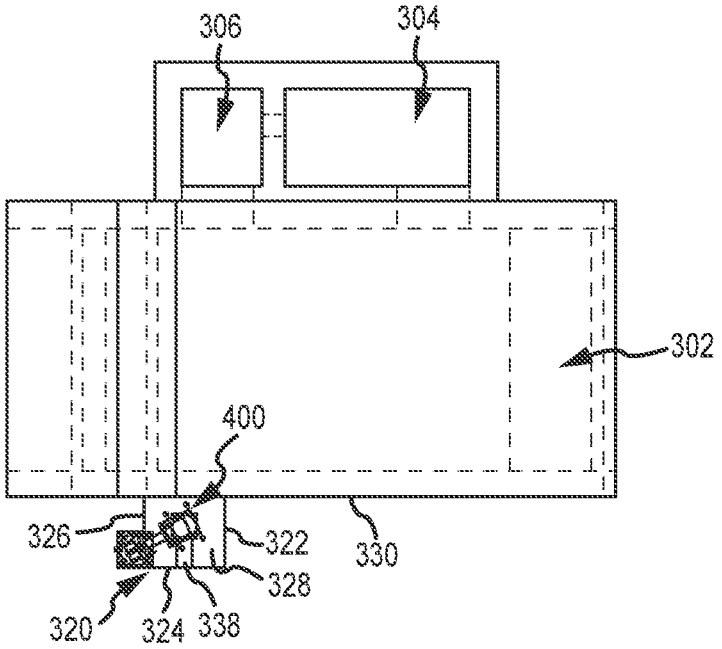
FIG. 8 is a top view of the system of FIG. 7 attached to or formed as part of a reverbatory furnace.
Figure 9:
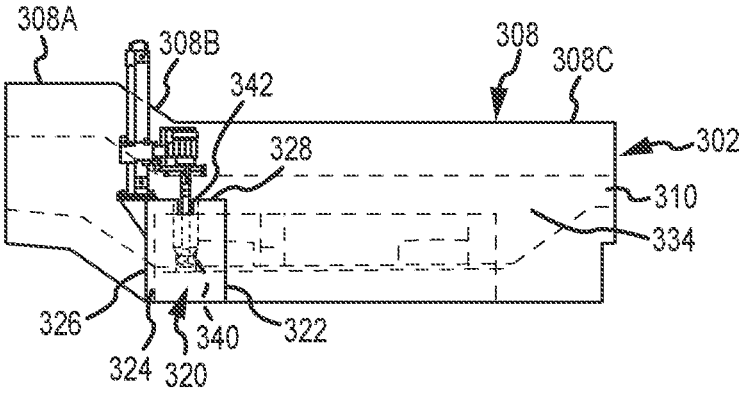
FIG. 9 is a partial, cross-sectional view of the system of FIG. 8.
Figure 11:
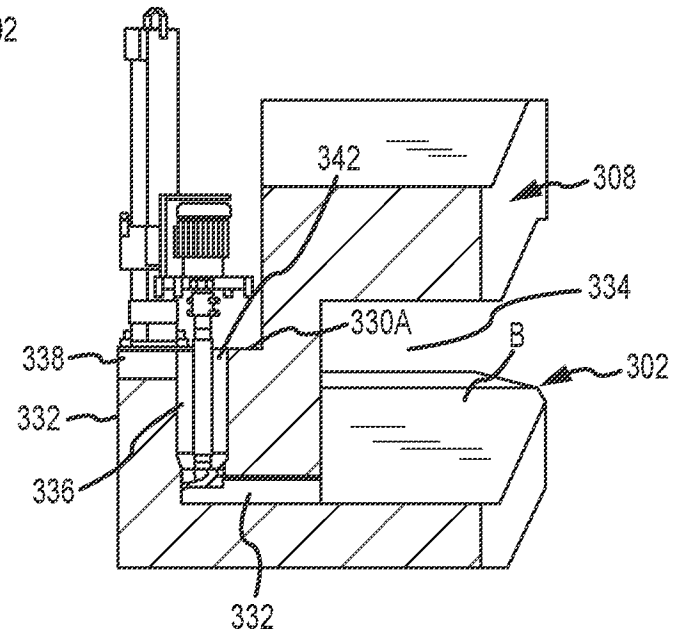
FIG. 11 is a partial, cross-sectional view of the system of FIG. 10 taken along line A-A.
Figure 10:
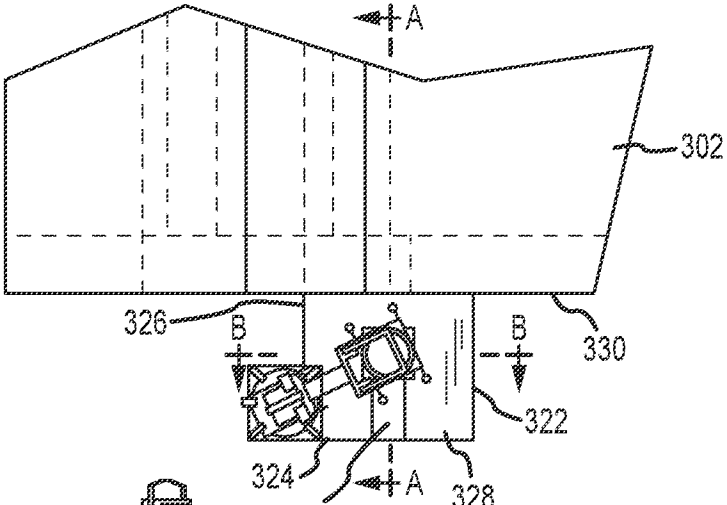
FIG. 10 is a top view of an alternate system according to the invention.
Figure 12:
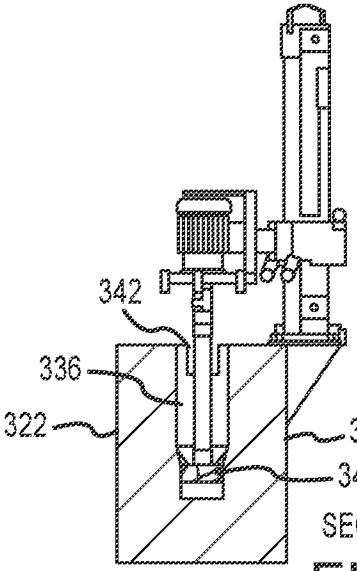
FIG. 12 is a partial, cross-sectional view of the system of FIG. 10 taken along line B-B.
Figure 13:
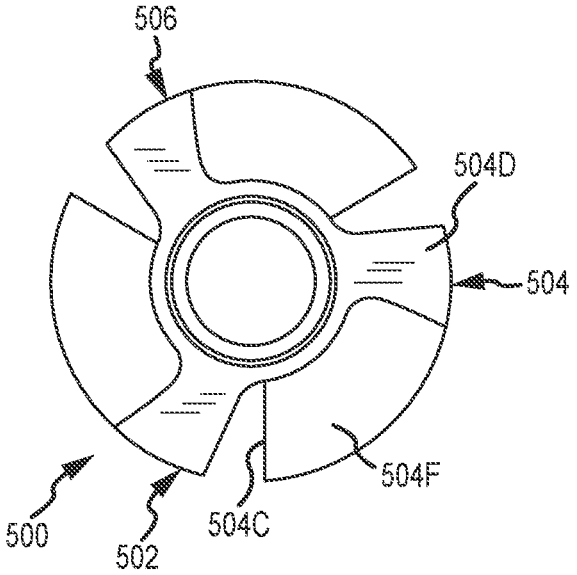
FIG. 13 is a top view of a rotor according to the invention.
Figure 14:
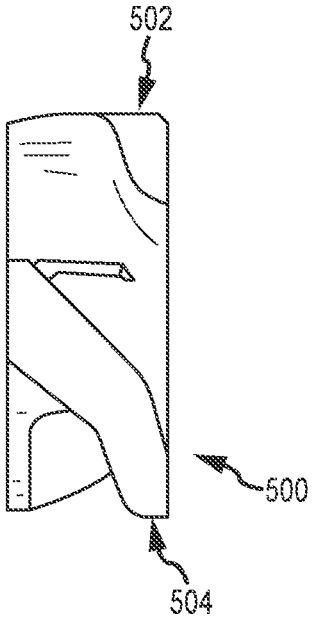
FIGS. 14 and 15 are side views of the rotor of FIG. 13.
Figure 15:
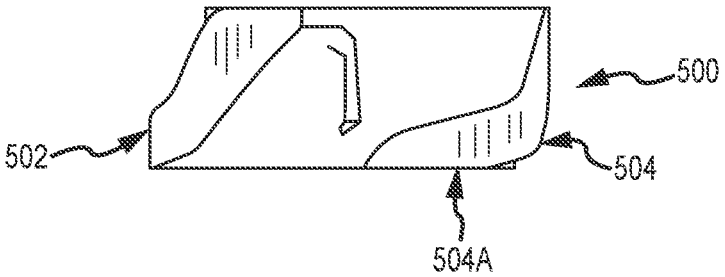
Figure 16:
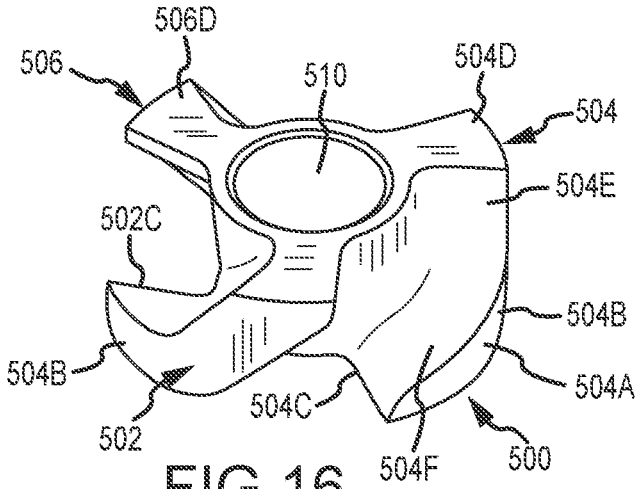
FIGS. 16 and 17 are top, perspective views of the rotor of FIG. 13 at different, respective positions of the rotor.
Figure 17:
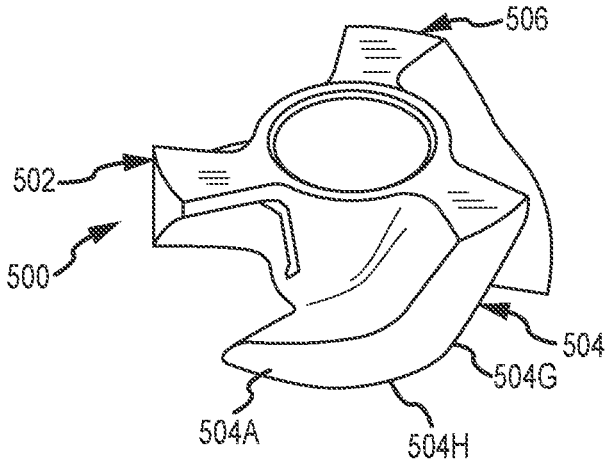
Figure 19:
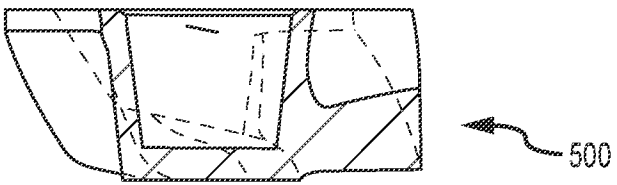
FIG. 19 is a cross-sectional view of the rotor of FIG. 18 taken along line A-A.
Figure 18:
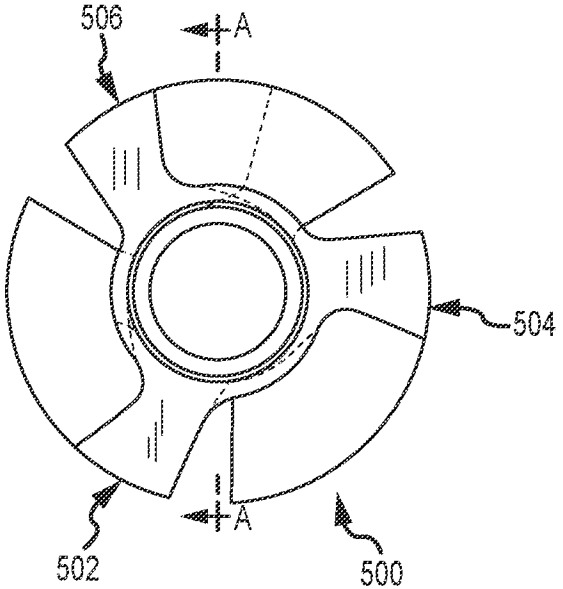
FIG. 18 is a top view of the rotor of FIG. 13.

Turning now to the drawings, where the purpose is to describe a preferred embodiment of the invention and not to limit same, systems and devices according to the invention will be described.

The invention includes a transfer chamber used with a vessel for the purpose of transferring molten metal out of the vessel in a controlled fashion using a pump, rather than relying upon gravity. It also is more preferred than using a transfer pump having a standard riser tube (such as the transfer pumps disclosed in the Background section) because, among other things, the use of such pumps create turbulence that creates dross and the riser tube can become plugged with solid metal.

FIGS. 1-6 show one preferred embodiment of the invention. A system 1 comprises a vessel 2, a transfer chamber 50 and a pump 100. Vessel 2 can be any vessel that holds molten metal (depicted as molten metal bath B), and as shown in this embodiment is an intermediary holding vessel. Vessel 2 has a first wall 3 and a second, opposite wall 4. Vessel 2 has support legs 5, inner side walls 6 and 7, inner end walls 6A and 7A, and an inner bottom surface 8. Vessel 2 further includes a cavity 10 that may be open at the top, as shown, or covered. An inlet 12 allows molten metal to flow into the cavity 10 and molten metal flows out of the cavity 10 through outlet 14. At the top 16 of vessel 2, there are flat surfaces 18 that preferably have metal flanges 20 attached. A tap-out port 22 is positioned lower than inner bottom surface 8 and has a plug 22A that can be removed to permit molten metal to exit tap-out port 22. As shown, inner bottom surface 8 is angled downwards from inlet 12 to outlet 14, although it need not be angled in this manner.

A transfer chamber according to the invention is most preferably comprised of a high temperature, castable cement, with a high silicon carbide content, such as ones manufactured by AP Green or Harbison Walker, each of which are part of ANH Refractory, based at 400 Fairway Drive, Moon Township, Pa. 15108, or Allied Materials. The cement is of a type know by those skilled in the art, and is cast in a conventional manner known to those skilled in the art.

Transfer chamber 50 in this embodiment is formed with and includes end wall 7A of vessel 2, although it could be a separate structure built outside of vessel 2 and positioned into vessel 2. Wall 7A is made in suitable manner. It is made of refractory and can be made using wooden forms lined with Styrofoam and then pouring the uncured refractory (which is a type of concrete known to those skilled in the art) into the mold. The mold is then removed to leave the wall 7A. If Styrofoam remains attached to the wall, it will burn away when exposed to molten metal.

Transfer chamber 50 includes walls 7A, 52, 53 and 55, which define an enclosed, cylindrical (in this embodiment) portion 54 that is sometimes referred to herein as an uptake section. Uptake section 54 has a first section 54A, a narrower third section 54B beneath section 54A, and an even narrower second section 54C beneath section 54B. An opening 70 is in communication with area 10A of cavity 10 of vessel 2.

Pump 100 includes a motor 110 that is positioned on a platform or superstructure 112. A drive shaft 114 connects motor 110 to rotor 500. In this embodiment, drive shaft 114 includes a motor shaft (not shown) connected to a coupling 116 that is also connected to a rotor drive shaft 118. Rotor drive shaft 118 is connected to rotor 500, preferably by being threaded into a bore at the top of rotor 500 (which is described in more detail below).

Pump 100 is supported in this embodiment by a brackets, or support legs 150. Preferably, each support leg 150 is attached by any suitable fastener to superstructure 112 and to sides 3 and 4 of vessel 2, preferably by using fasteners that attach to flange 20. It is preferred that if brackets or metal structures of any type are attached to a piece of refractory material used in any embodiment of the invention, that bosses be placed at the proper positions in the refractory when the refractory piece is cast. Fasteners, such as bolts, are then received in the bosses.

Rotor 500 is positioned in uptake section 54 preferably so there is a clearance of ¼ or less between the outer perimeter of rotor 500 and the wall of uptake section 54. As shown, rotor 500 is positioned in the lowermost second section 54C of uptake section 54 and its bottom surface is approximately flush with opening 70. Rotor 500 could be located anywhere where it would push molten metal from area 10A upward into uptake section 54 with enough pressure for the molten metal to reach and pass through outlet 14, thereby exiting vessel 2. For example, rotor 500 could only partially located in uptake section 54 (with part of rotor 500 in area 10A, or rotor 500 could be positioned higher in uptake section 54, as long as it fit sufficiently to generate adequate pressure to move molten metal into outlet 14.

Another embodiment of the invention is system 300 shown in FIGS. 7-12. In this embodiment a transfer chamber 320 is positioned adjacent a vessel, such as a reverbatory furnace 301, for retaining molten metal.

System 300 includes a reverbatory furnace 302, a charging well 304 and a well 306 for housing a circulation pump. In this embodiment, the reverbatory furnace 302 has a top covering 308 that includes three surfaces: first surface 308A, second, angled surface 308B and a third surface 308C that is lower than surface 308A and connected to surface 308A by surface 308B. The purpose of the top surface 308 is to retain the heat of molten metal bath B.

An opening 310 extends from reverbatory furnace 302 and is a main opening for adding large objects to the furnace or draining the furnace.

Transfer well 320, in this embodiment, has three side walls 322, 324 and 326, and a top surface 328. Transfer well 320 in this embodiment shares a common wall 330 with furnace 302, although wall 330 is modified to create the interior of the transfer well 320. Turning now to the inside structure of the transfer well 320, it includes an intake section 332 that is in communication with a cavity 334 of reverbatory furnace 302. Cavity 334 includes molten metal bath B when system 300 is in use, and the molten metal can flow through intake section 332 into transfer well 320.

Intake section 332 leads to an enclosed section 336 that leads to an outlet 338 through which molten metal can exit transfer well 320 and move to another structure or vessel. Enclosed section 336 is preferably square, and fully enclosed except for an opening 340 at the bottom, which communicates with intake section 332 and an opening 342 at the top of enclosed section 336, which is above and partially includes the opening that forms outlet 338.

In order to help form the interior structure of well 320, wall 330 has an extended portion 330A that forms part of the interior surface of intake section 332. In this embodiment, opening 340 has a diameter, and a cross sectional area, smaller than the portion of enclosed section 336 above it. The cross-sectional area of enclosed section 336 may remain constant throughout, may gradually narrow to a smaller cross-sectional area at opening 340, or there may be one or more intermediate portions of enclosed section 336 of varying diameters and/or cross-sectional areas.

A pump 400 has the same preferred structure as previously described pump 100. Pump 400 has a motor 402, a superstructure 404 that supports motor 402, and a drive shaft 406 that includes a motor drive shaft 408 and a rotor drive shaft 410. A rotor 500 is positioned in enclosed section 336, preferably approximately flush with opening 340. Where rotor 500 is positioned it is preferably ¼" or less; or ⅛" or less, smaller in diameter than the inner diameter of the enclosed section 336 in which it is positioned in order to create enough pressure to move molten metal upwards.

A preferred rotor 500 is shown in FIGS. 13-19. Rotor 500 is designed to push molten metal upward into enclosed section 336. The preferred rotor 500 has three identically formed blades 502, 504 and 506. Therefore, only one blade shall be described in detail. It will be recognized, however, that any suitable number of blades could be used or that another structure that pushes molten metal up the enclosed section could be utilized.

Blade 504 has a multi-stage blade section 504A that includes a face 504F. Face 504F is multi-faceted and includes portions that work together to move molten metal upward into the uptake section. The rotor preferably comprises one or more rotor blades, wherein each blade includes: (a) a first portion having (i) a leading edge with a thickness of ⅛" or greater, (ii) a first upper surface angled to direct molten metal upwards, and (iii) a first bottom surface with an angle equal to or less than the angle of the first upper surface as measured from a vertical axis; and (b) a second portion integrally formed with the first portion, the second portion having (i) a second upper surface angled to direct molten metal upwards, the angle of the second upper surface being greater than the angle of the first upper surface as measured from the vertical axis, and (ii) a second bottom surface, the second bottom surface having an angle greater than the angle of the first bottom surface as measured from the vertical axis. As shown in FIGS. 13-17, each rotor blade 504 has a bottom 504B having a leading edge 504C and angled surface 504F. Angled surface 504F meets surface 504E, which is more vertical than surface 504F in order to push molten metal at least partially outward. Each blade 504 has a top surface 504D.

A system according to the invention may also utilize a standard molten metal pump, such as a circulation or gas-release (also called a gas-injection) pump 20. Pump 20 is preferably any type of circulation or gas-release pump. The structure of circulation and gas-release pumps is known to those skilled in the art and one preferred pump for use with the invention is called "The Mini," manufactured by Molten Metal Equipment Innovations, Inc. of Middlefield, Ohio 44062, although any suitable pump may be used. The pump 20 preferably has a superstructure 22, a drive source 24 (which is most preferably an electric motor) mounted on the superstructure 22, support posts 26, a drive shaft 28, and a pump base 30. The support posts 26 connect the superstructure 22 a base 30 in order to support the superstructure 22.

Drive shaft 28 preferably includes a motor drive shaft (not shown) that extends downward from the motor and that is preferably comprised of steel, a rotor drive shaft 32, that is preferably comprised of graphite, or graphite coated with a ceramic, and a coupling (not shown) that connects the motor drive shaft to end 32B of rotor drive shaft 32.

The pump base 30 includes an inlet (not shown) at the top and/or bottom of the pump base, wherein the inlet is an opening that leads to a pump chamber (not shown), which is a cavity formed in the pump base. The pump chamber is connected to a tangential discharge, which is known in art, that leads to an outlet, which is an opening in the side wall 33 of the pump base. In the preferred embodiment, the side wall 33 of the pump base including the outlet has an extension 34 formed therein and the outlet is at the end of the extension.

In operation, the motor rotates the drive shaft, which rotates the rotor. As the rotor (also called an impeller) rotates, it moves molten metal out of the pump chamber, through the discharge and through the outlet.

A circulation or transfer pump may be used to simply move molten metal in a vessel towards a transfer chamber according to the invention where the pump inside of the transfer chamber moves the molten metal up and into the outlet.

Figure 20:
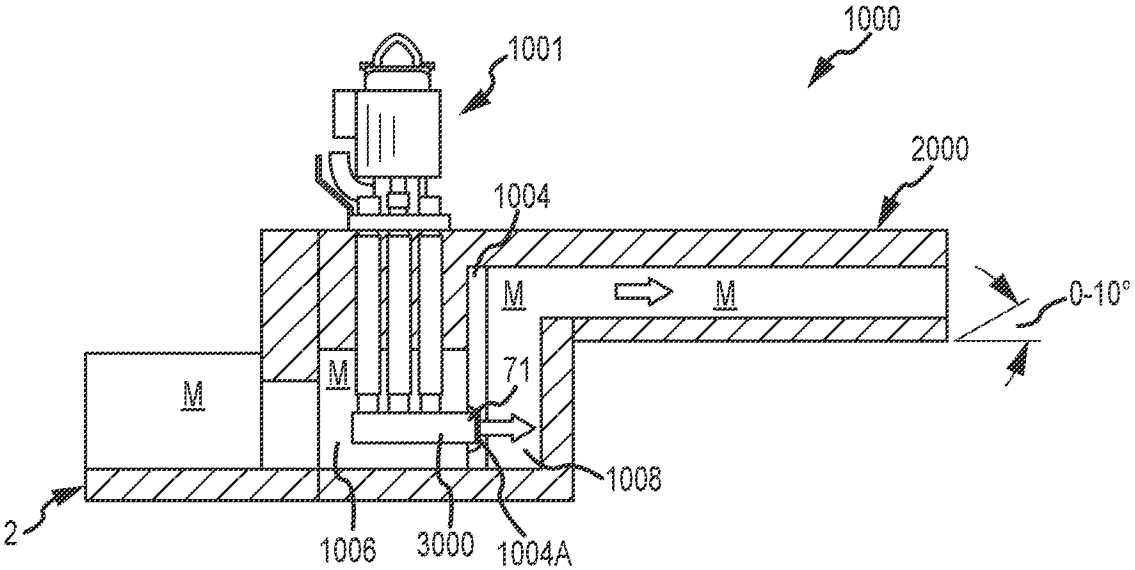
FIG. 20 is a side, partial cross-sectional view of an alternate embodiment of the invention.
Figure 21:
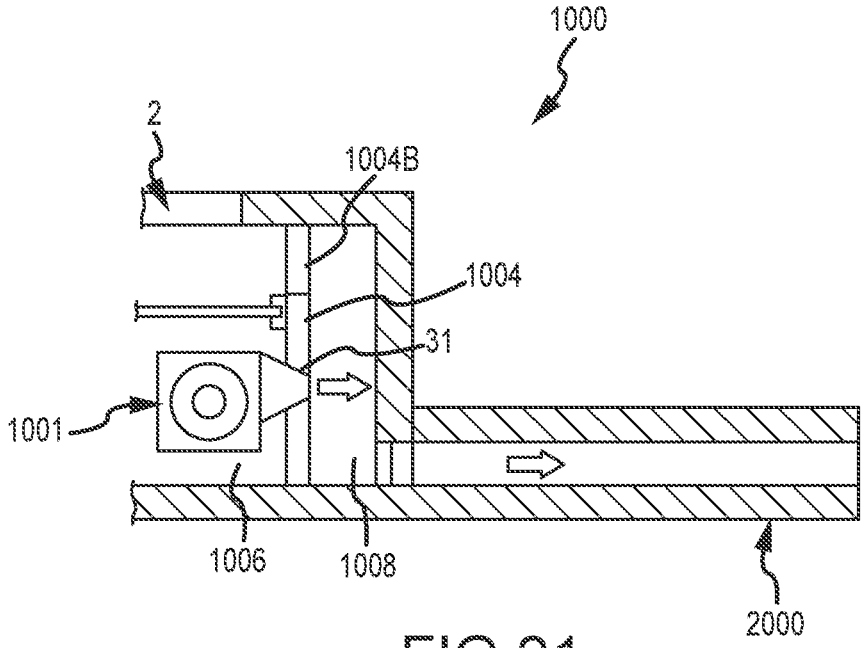
FIG. 21 is a top, partial cross-sectional view of the embodiment of FIG. 20.
Figure 22:
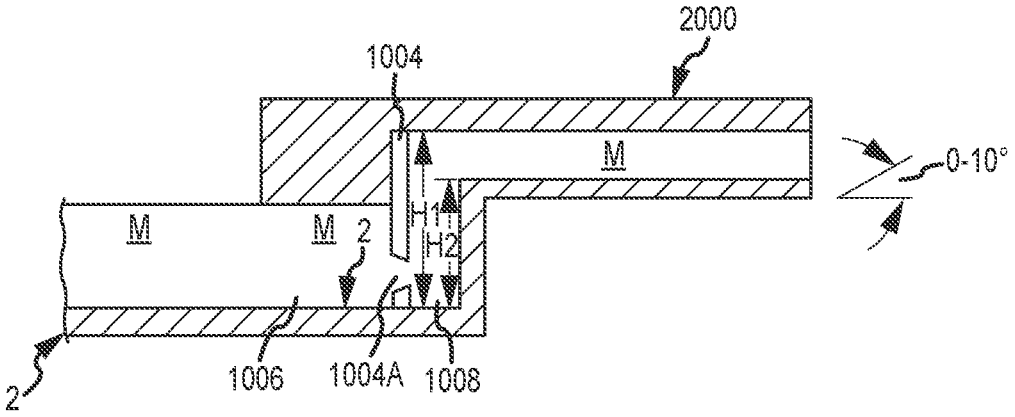
FIG. 22 is a partial, cross-sectional side view showing the height relationship between components of the embodiment of FIGS. 20-21.

Alternatively, a circulation or gas-transfer pump 1001 may be used to drive molten metal out of vessel 2. As shown in FIGS. 20-22, a system 1000 as an example, has a dividing wall 1004 that would separate vessel 2 into at least two chambers, a first chamber 1006 and a second chamber 1008, and any suitable structure for this purpose may be used as dividing wall 1004. As shown in this embodiment, dividing wall 1004 has an opening 1004A and an optional overflow spillway 1004B, which is a notch or cut out in the upper edge of dividing wall 1004. Overflow spillway 1004B is any structure suitable to allow molten metal (designated as M) to flow from second chamber 1008, past dividing wall 1004, and into first chamber 1006 and, if used, overflow spillway 1004B may be positioned at any suitable location on wall 1004. The purpose of optional overflow spillway 1004B is to prevent molten metal from overflowing the second chamber 1008, by allowing molten metal in second chamber 1008 to flow back into first chamber 1006 or vessel 2 or other vessel used with the invention.

At least part of dividing wall 1004 has a height H1, which is the height at which, if exceeded by molten metal in second chamber 1008, molten metal flows past the portion of dividing wall 1004 at height H1 and back into first chamber 1006 of vessel 2. Overflow spillway 1004B has a height H1 and the rest of dividing wall 1004 has a height greater than H1. Alternatively, dividing wall 1004 may not have an overflow spillway, in which case all of dividing wall 1004 could have a height H1, or dividing wall 1004 may have an opening with a lower edge positioned at height H1, in which case molten metal could flow through the opening if the level of molten metal in second chamber 1008 exceeded H1. H1 should exceed the highest level of molten metal in first chamber 1006 during normal operation.

Second chamber 1008 has a portion 1008A, which has a height H2, wherein H2 is less than H1 (as can be best seen in FIG. 2A) so during normal operation molten metal pumped into second chamber 1008 flows past wall 1008A and out of second chamber 1008 rather than flowing back over dividing wall 1004 and into first chamber 1006.

Dividing wall 1004 may also have an opening 1004A that is located at a depth such that opening 1004A is submerged within the molten metal during normal usage, and opening 1004A is preferably near or at the bottom of dividing wall 1004. Opening 1004A preferably has an area of between 6 in.$^2$ and 24 in.$^2$, but could be any suitable size.

Dividing wall 1004 may also include more than one opening between first chamber 1006 and second chamber 1008 and opening 1004A (or the more than one opening) could be positioned at any suitable location(s) in dividing wall 1004 and be of any size(s) or shape(s) to enable molten metal to pass from first chamber 1006 into second chamber 1008.

Optional launder 2000 (or any launder according to the invention) is any structure or device for transferring molten metal from a vessel such as vessel 2 or 302 to one or more structures, such as one or more ladles, molds (such as ingot molds) or other structures in which the molten metal is ultimately cast into a usable form, such as an ingot. Launder 2000 may be either an open or enclosed channel, trough or conduit and may be of any suitable dimension or length, such as one to four feet long, or as much as 100 feet long or longer. Launder 2000 may be completely horizontal or may slope gently upward, back towards the vessel. Launder 2000 may have one or more taps (not shown), i.e., small openings stopped by removable plugs. Each tap, when unstopped, allows molten metal to flow through the tap into a ladle, ingot mold, or other structure. Launder 2000 may additionally or alternatively be serviced by robots or cast machines capable of removing molten metal M from launder 20.

It is also preferred that the pump 1001 be positioned such that extension 31 of base 3000 is received in the first opening 1004A. This can be accomplished by simply positioning the pump 1001 in the proper position. Further the pump may be held in position by a bracket or clamp that holds the pump against the dividing wall 1004, and any suitable device may be used. For example, a piece of angle iron with holes formed in it may be aligned with a piece of angle iron with holes in it on the dividing wall 1004, and bolts could be placed through the holes to maintain the position of the pump 1001 relative the dividing wall 1004.

In operation, when the motor is activated, molten metal is pumped out of the outlet through first opening 1004A, and into chamber 1008. Chamber 1008 fills with molten metal until it moves out of the vessel 2 through the outlet. At that point, the molten metal may enter a launder or another vessel.

If the molten metal enters a launder, the launder preferably has a horizontal angle of 0° or is angled back towards chamber 1008 of the vessel 2. The purpose of using a launder with a 0° slope or that is angled back towards the vessel is because, as molten metal flows through the launder, the surface of the molten metal exposed to the air oxidizes and dross is formed on the surface, usually in the form of a semi-solid or solid skin on the surface of the molten metal. If the launder slopes downward it allows gravity to influence the flow of molten metal, and tends to pull the dross or skin with the flow. Thus, the dross, which includes contaminants, is included in downstream vessels and adds contaminants to finished products.

It has been discovered that if the launder is at a 0° or horizontal angle tilting back towards the vessel, the dross remains as a skin on the surface of the molten metal and is not pulled into downstream vessels to contaminate the molten metal inside of them. The preferred horizontal angle of any launder connected to a vessel according to aspects of the invention is one that is at 0° or slopes (or tilts) back towards the vessel, and is between 0° and 10°, or 0° and 5°, or 0° and 3°, or 1° and 3°, or a backward slope of about ⅛" for every 10' of launder length.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A method for transferring molten metal from a first vessel configured to contain molten metal, wherein the first vessel comprises: (a) interior walls; (b) a cavity defined by the interior walls, the cavity configured for retaining molten metal; (c) a first side wall and a second side wall opposite the first side wall, (d) an opening in communication with the cavity; (e) an uptake section positioned in the cavity and that is above, and in fluid communication with, the opening, wherein the uptake section is configured to move molten metal upward and therethrough, (f) one or more brackets for positioning the molten metal pump in the cavity, (g) an outlet above the opening, the outlet in fluid communication with the uptake section, wherein the outlet is configured so that molten metal can exit the uptake section through the outlet; and (h) a molten metal pump having a motor, a drive shaft having a first end connected to the motor and extending into the uptake section, the drive shaft further having a second end connected to a rotor, wherein the rotor is configured to move molten metal upward into the uptake section;

the method comprising the steps of: attaching the pump to the one or more brackets, operating the pump to move molten metal in the first vessel up in to the uptake section and through the outlet.

2. The method of claim 1, wherein the first vessel further includes an inner bottom surface that slopes downward towards the opening.

3. The method of claim 1 that further includes the step of adding molten metal to the first vessel.

4. The method of claim 1, wherein the pump is operated continuously for a period of time determined by an operator.

5. The method of claim 1 that further includes the step of positioning the rotor and drive shaft at least partially in the cavity.

6. The method of claim 1, wherein the first vessel further includes a tap-out opening positioned lower than the opening.

7. The method of claim 1, wherein the outlet is at least two feet above the opening.

8. The method of claim 1, wherein the first vessel further comprises an inner bottom surface and the outlet is at least two feet above the inner bottom surface.

9. The method of claim 1, wherein the opening has a cross-sectional area and the uptake section has a second cross-sectional area, the second cross-sectional area being larger than the cross-sectional area.

10. The method of claim 1, wherein the uptake section is cylindrical.

11. The method of claim 1, wherein the uptake section has a first vertical section with a first cross-sectional area and a second vertical section having a second cross-sectional area, the second cross-sectional area adjacent the opening, and the second cross-sectional area being smaller than the first cross-sectional area.

12. The method of claim 1, wherein the opening has a cross-sectional area and the uptake section has a second cross-sectional area, the second cross-sectional area being smaller than the cross-sectional area.

13. The method of claim 12, wherein the one or more brackets comprises two metal beams that extend from the first side wall to the second side wall, and each of the metal beams is connected to the first side wall and the second side wall.

14. The method of claim 13, wherein each beam is L-shaped.

15. The method of claim 1 that further includes a wall dividing the first vessel into a first section and a second section, wherein the second section includes the transfer chamber, and that further includes the step of pumping molten metal from the first section to the second section.

16. The method of claim 2, wherein the first vessel further compresses an inner bottom surface and the opening is 3" or more above the inner bottom surface.

17. The method of claim 1, wherein the uptake section has three walls inside of the vessel cavity and has a fourth wall that is an inner surface of an outer wall of the vessel.

18. The method of claim 1, wherein the first vessel further includes one or more brackets for positioning a pump in the cavity and that further includes the steps of positioning the pump in the cavity and attaching the pump to the one or more brackets.

19. The method of claim 18, wherein the one or more brackets and transfer chamber are configured so that when the pumping device is positioned in the transfer section the rotor is partially or entirely within the uptake section.

20. The method of claim 1 that further includes a launder in communication with the outlet and that further includes the step of pumping molten metal through the outlet and into the launder.

21. The method of claim 1, wherein the molten metal pump does not include a pump housing connected to a superstructure.

22. The method of claim 1, wherein the pump does not include support posts.

23. The method of claim 1, wherein the rotor comprises one or more rotor blades, and each blade includes: (a) a first portion having (i) a leading edge with a thickness of ⅛" or greater, (ii) a first upper surface angled to direct molten metal upwards, and (iii) a first bottom surface with an angle equal to or less than the angle of the first upper surface as measured from a vertical axis; and (b) a second portion integrally formed with the first portion, the second portion having (i) a second upper surface angled to direct molten metal upwards, the angle of the second upper surface being greater than the angle of the first upper surface as measured from the vertical axis, and (ii) a second bottom surface, the second bottom surface having an angle greater than the angle of the first bottom surface as measured from the vertical axis.

24. The method of claim 1, wherein the rotor has a diameter and is positioned in the cavity and the portion of the cavity in which the rotor is positioned in is circular and has a diameter of ¼" or less than the diameter of the rotor.

25. The method of claim 7, wherein the opening has a diameter of 1/32"-1⅛" greater than the diameter of the rotor.

26. The method of claim 12, wherein the rotor is positioned at least partially in the second section.

27. The method of claim 1 that further includes a superstructure for supporting the motor.

28. The method of claim 1 that further includes the step of constructing a rotor shaft with a height sufficient to position the rotor at least partially in the uptake portion.

29. The method of claim 1 that further includes the step of constructing a drive shaft with a height sufficient to position the rotor at least partially in the uptake portion.

30. The method of claim 12 that further includes the step of constructing a rotor shaft with a height sufficient to position the rotor at least partially in the second section.

31. The method of claim 27 that further includes the step of constructing a rotor with a diameter that is 1/32" to 1⅛" less than the diameter of the opening.

32. The method of claim 17 that further includes the step of constructing one or more pump brackets configured to connect the pump to the one or more brackets.

* * * * *